US008299424B2

(12) United States Patent
Camilli

(10) Patent No.: US 8,299,424 B2
(45) Date of Patent: Oct. 30, 2012

(54) SYSTEMS AND METHODS FOR ANALYZING UNDERWATER, SUBSURFACE AND ATMOSPHERIC ENVIRONMENTS

(75) Inventor: Richard Camilli, Woods Hole, MA (US)

(73) Assignee: Woods Hole Oceanographic Institution, Woods Hole, MA (US)

( * ) Notice: Subject to any disclaimer, the term of this patent is extended or adjusted under 35 U.S.C. 154(b) by 465 days.

(21) Appl. No.: 11/796,874

(22) Filed: Apr. 30, 2007

(65) Prior Publication Data

US 2009/0084976 A1 Apr. 2, 2009

(51) Int. Cl.
*H01J 49/00* (2006.01)

(52) U.S. Cl. ..... 250/288; 250/281; 250/282; 73/53.01; 73/64.56

(58) Field of Classification Search ..... 250/288, 250/298, 281, 282; 73/64.56, 53.01
See application file for complete search history.

(56) References Cited

U.S. PATENT DOCUMENTS

| | | | | |
|---|---|---|---|---|
| 3,023,310 | A | 2/1962 | Maxwell | |
| 3,429,105 | A * | 2/1969 | Llewellyn et al. | 96/5 |
| 3,828,527 | A * | 8/1974 | Briggs et al. | 96/4 |
| 5,313,061 | A * | 5/1994 | Drew et al. | 250/281 |
| 5,639,956 | A * | 6/1997 | Christy | 73/19.01 |
| 6,309,184 | B1 * | 10/2001 | Moraja et al. | 417/51 |
| 7,385,191 | B1 * | 6/2008 | McMurtry et al. | 250/288 |
| 7,750,292 | B2 * | 7/2010 | Finlay | 250/289 |
| 2002/0079441 | A1 * | 6/2002 | Fries et al. | 250/281 |
| 2002/0079442 | A1 * | 6/2002 | Fries et al. | 250/281 |
| 2005/0230614 | A1 * | 10/2005 | Glukhoy | 250/287 |
| 2007/0102650 | A1 * | 5/2007 | Katagiri et al. | 250/492.3 |
| 2007/0212750 | A1 * | 9/2007 | Kieffer et al. | 435/34 |
| 2010/0084549 | A1 * | 4/2010 | Ermakov et al. | 250/283 |

OTHER PUBLICATIONS

Harry Hemond and Richard Camilli, NEREUS: engineering concept for an underwater mass spectrometer, 2002, trends in analytical chemistry, vol. 21, No. 8, p. 526-533.*
Harry Hemond and Richard Camilli, NEREUS/Kemonaut, a mobile autonomous underwater mass spectrometer, Apr. 2004, Science Direct, Trends in analytical chemistry, vol. 23, issue 4, pp. 307-313.*
Camilli et al. "Underwater vacuum technology", Vacuum Technology and coating, Dec. 2005, pp. 34-39.*
Hock et al. "A mass spectrometer inlet system for sampling gases dissolved in liquid phases", Archives of Biochemistry and Biophysics, vol. 101, Issue 1, Apr. 1963, pp. 160-170.*
International Search Report for PCT/US2008/005288 mailed Aug. 7, 2009.

* cited by examiner

*Primary Examiner* — Michael Logie
(74) *Attorney, Agent, or Firm* — Ropes & Gray LLP

(57) ABSTRACT

The systems and methods described herein include, among other things, systems capable of being deployed for long periods of time in oceanic, subsurface and atmospheric environments. The systems typically include mass spectrometers to measure low molecular weight gases dissolved in the water and volatile chemicals in air and water, and can move through the ocean, subsurface and atmospheric environment to take samples over a large geographic area. Additionally, these mass spectrometer devices are small and require little power and thereby facilitate the development of sample collection devices that can be placed at a remote location and operated for a substantial period of time from an on-board power supply such as a battery or a fuel cell. Such small and light-weight mass spectrometer devices when combined with low power AUVs (Autonomous Underwater Vehicles) and other manned and un-manned vehicles, can take samples over substantial distances and for a substantial period of time.

47 Claims, 18 Drawing Sheets

SYSTEMS AND METHODS FOR ANALYZING UNDERWATER, SUBSURFACE AND ATMOSPHERIC ENVIRONMENTS

BACKGROUND

There is an increasing need for long term observation of the earth-ocean system. In particular, there is a need to study, identify and quantify the chemical constituents present in the water column including dissolved gases such as methane, hydrogen sulfide, nitrogen, carbon dioxide and oxygen. A study of the chemical constituents enables scientists to track changes in theses chemicals over time and thereby monitor oceanic processes as well as improve predictive modeling of complex natural phenomena that vary over a longer timescale. In general, such a study has a wide range of scientific, industrial, environmental and military uses including monitoring shipping lanes, and monitoring and mitigating hazardous chemicals.

Cabled observatories located near the ocean bed allow for continuous in-situ sampling of the underwater environments at desired sites. Since they are typically located in a particular site and tethered to the ocean floor, they have several advantages including having ability to capture significant transient phenomena and sudden changes in the ocean environment, and since they are in-situ, eliminating the problems associated with sample transportation and storage. However, current technologies for studying the chemical constituents using these cabled observatories for reliable long-term operation underwater are limited. These cabled observatories are typically equipped with commercially available dissolved gas sensors, such as the Clark type oxygen electrode, that are capable of measuring only single gas species and operate for only a few weeks before degrading in performance. More powerful instrumentation such as gas chromatographs are not suited for autonomous long-term underwater operation since they need consumables and require regular maintenance. An increasing trend is the use of mass spectrometers in cabled observatories.

Mass spectrometers are well suited for in-situ analysis of dissolved gases and volatile chemicals in the water column, because they can quickly detect multiple dissolved chemicals at low concentrations, and can work without exhaust or consumable reagents. However, current autonomous platforms such as moorings, tow fish and autonomous underwater vehicles utilizing mass spectrometers preclude long-term seafloor use because they do not have the endurance or depth capability. Additionally, they are unable to adequately resolve low mass chemicals such as hydrogen, helium and methane. Such systems are described in the MIT PhD thesis titled "Creation and Deployment of the NEREUS Autonomous Underwater Chemical Analyzer and Kemonaut, an Odyssey Class Submarine" dated May 2003 and MIT Masters thesis titled "The Development of Components for In-Situ Mass Spectrometer" dated May 2000, the contents of each of which are incorporated herein by reference in their entirety.

Accordingly, there is a need for a submersible system to perform long-term series sampling of dissolved gases in a water column in the ocean depths (e.g., at depths greater than 2500 m). There is also a need for a reduced size mass spectrometer devices that can facilitate, among other things, mobile sensing devices that may move through the ocean environment and take samples over a large geographic area.

In addition to analyzing underwater environments, there is a need for accurate observation of atmospheric and subsurface environments. In particular, there is a need for a fast and reliable system for detecting hazardous gases in populated urban centers where the speed and accuracy of detection can save lives in the event of chemical spills or acts of bioterrorism. Similarly, in oil and natural gas applications, there is a need for measuring volatile gases such as hydrocarbons while controlling the seepage of water vapor into the instrumentation. Current systems typically utilize infra-red sensors that are prone to error from unwanted atmospheric water vapor molecules entering the measurement system. Furthermore, current systems do not utilize more sensitive mass spectrometers because they require the continuous maintenance of low pressure conditions and strict control of substances entering the instrumentation.

Accordingly, there is a need for compact systems capable of being operated with mass spectrometers to analyze oceanic, atmospheric and subsurface environments. Generally, there is a need for a compact system to sample and detect volatile substances and dissolved gases in both underwater as well as atmospheric environments both over and under the surface of the earth.

SUMMARY OF THE INVENTION

The systems and methods described herein include, among other things, submersible systems capable of being deployed for long periods of time near the ocean bed. The systems and methods described herein also include, among other things, systems capable of detecting substances in atmospheric and subsurface environments.

In one aspect, the systems typically include mass spectrometers to measure low molecular weight gases dissolved in the water and can be moved through the ocean environment to take samples over a large geographic area. Additionally, these mass spectrometer devices are small and require little power and thereby facilitate the development of sample collection devices that can be placed at a remote location and operated for a substantial period of time from an on-board power supply such as a battery or a fuel cell. Such small and lightweight mass spectrometer devices when combined with low power AUVs (Autonomous Underwater Vehicles), can take samples over substantial distances and for a substantial period of time.

In particular, the systems and methods disclosed herein include systems for performing a chemical analysis of substances in an underwater environment at a particular depth. The systems may comprise a housing and an inlet assembly, connected to the housing and capable of allowing one or more substances from the underwater environment to diffuse into the housing. A vacuum chamber may be disposed within the housing and capable of maintaining a vacuum and connected to the inlet assembly for receiving the one or more substances. An analyzer may be disposed within the vacuum chamber for detecting one or more of the substances, and a permanent magnet assembly may be disposed near the vacuum chamber for generating a substantially homogeneous magnetic field within a portion of the analyzer. In certain embodiments, the systems are adapted to perform chemical analysis of substances in an underwater environment at depths greater than 2500 meters.

The inlet assembly may be capable of withstanding external pressures greater than about 500 atmospheres for an extended period of time, while being subjected to internal pressures of about $10^{-8}$ Torr within the housing. The inlet assembly may include an inlet membrane. The inlet membrane may be formed from hydrophobic materials and/or materials having slow permeability rate constants, high temperature coefficients and high tensile strengths. In certain embodiments, the inlet membrane may comprise a polymer.

The polymer may include at least one of high-density polyethylene (HDPE), polymethylpentene (PMP), polypropylene, trespaphan GND, polytetrafluoroethylene, Hostaflon PFA, and polyimino-1-oxohexamethylene. The inlet assembly may include an inlet tube connecting the inlet membrane and the vacuum chamber. In certain embodiments, the inlet assembly further comprises a backing plate attached to the inlet membrane for providing additional structural support to the inlet membrane. The backing plate may be formed from metal. In certain embodiments, the backing plate includes metal plates arranged as a louver. In other embodiments, the backing plate includes perforations. In certain embodiments, a portion of the inlet assembly is disposed within the housing and a portion of the inlet assembly is disposed outside the housing. The inlet assembly may extend outwardly from the housing.

In certain embodiments, the housing is substantially formed from water impermeable materials and/or materials capable of withstanding high external pressures greater than about 500 atmospheres. The housing may be formed from at least one of stainless steel, titanium and aluminum. The housing may be formed from materials capable of being disposed in water for a length of time greater than about one month. In certain embodiments, the housing is substantially cylindrically shaped. In such embodiments, one or more hemispherical end caps are attached to end portions of the housing. The housing includes a vacuum chamber that may be connected via an inlet tube to the inlet assembly. In certain embodiments, the vacuum chamber is formed from at least one of stainless steel, titanium and aluminum. The vacuum chamber may include closable openings for connecting at least one of the inlet tube, the ion pump and control electronics.

The pressure in the vacuum chamber may be maintained using an ion pump. In certain embodiments, the vacuum chamber may be de-pressurized to a particular level prior to being submerged underwater. In such embodiments, the ion pump maintains the pressure in the vacuum chamber at a level equal to or below the prior particular level. The ion pump may be disposed within the housing and connected to the vacuum chamber for generating a vacuum therein. In certain embodiments, the ion pump includes an NEG-ion pump.

The vacuum chamber may be sized and shaped to house an analyzer for analyzing substances in the underwater environment. In certain embodiments, the analyzer includes an ion source for ionizing the one or more substances, a mass selector for separating the ionized substances, and a detector for detecting the ionized substances. In such embodiments, the mass selector may include a cycloidal mass selector, the detector may include a Faraday cup detector and the ion source may include a heated tungsten filament. The analyzer may be configured with electrodes for generating an electric field within the mass selector. In certain embodiments, the mass selector requires a magnetic field transverse to the electric field for separating the ionized substances. In such embodiments, the system comprises a permanent magnet assembly for generating a magnetic field within the mass selector.

The permanent magnet assembly may be sized and shaped to fit around a portion of the vacuum chamber. In certain embodiments, the permanent magnet assembly includes a magnet carrier, one or more magnetic members and one or more pole pieces tapered along one or more edges. In certain embodiments, one or more of the magnetic members are disposed in between one or more pole pieces and the magnet carrier. The permanent magnet assembly may comprise two pole pieces and two magnetic members. The permanent magnet assembly may have an asymmetric shape. In certain embodiments, one or more magnetic members are formed from NdFeB. At least one of the one or more pole pieces and magnet carrier may be formed from low carbon steel. The magnet carrier may be shaped to minimize fringing effects in the substantially homogeneous magnetic field.

In certain embodiments, the system further comprises a flow pump connected to the inlet assembly for providing a continuous flow of at least one of water and one or more substances to a region near the inlet assembly. In other embodiments, the system further comprises a flow pump connected to the inlet assembly for providing a continuous flow of at least one of water and one or more substances to a region near the inlet membrane. The flow pump may include an impeller pump. In certain embodiments, the system comprises at least one of a conductivity sensor, a temperature sensor and a depth sensor.

In certain embodiments, the system comprises a computer connected to the analyzer for at least one of analyzing and storing the one or more detected substances. In such embodiments, the system further comprises a controller connected to the computer and the analyzer for modifying the operation of at least one of the computer and analyzer in response to one or more of detected substances.

In another aspect, the systems and methods described herein include an inlet apparatus for collecting substances in an underwater environment. The apparatus includes an inlet body having a recess and a hydrophobic inlet membrane capable of allowing one or more substances from the underwater environment to diffuse into the recess. The apparatus further includes a backing plate for supporting the hydrophobic inlet membrane and positioned within the recess such that a gap is created between the inlet body and the backing plate. In certain embodiments, the gap provides a path for the substances to pass through the recess.

In another aspect, the systems and methods described herein include systems for performing a chemical analysis of an underwater environment at a particular depth. The systems may include a housing and an inlet assembly having a hydrophobic inlet membrane, connected to the housing and capable of allowing one or more substances from the underwater environment to diffuse into the housing. The systems further include a vacuum chamber disposed within the housing, an analyzer disposed within the vacuum chamber, and a magnet disposed near the vacuum chamber. The vacuum chamber may be capable of maintaining a vacuum and is typically connected to the inlet assembly for receiving the one or more substances. The analyzer is typically used for detecting one or more of the substances and the magnet is used for generating a magnetic field within a portion of the analyzer.

In another aspect, the systems and methods described herein include systems for performing a chemical analysis of an underwater environment at a particular depth. The systems may include a housing and an inlet assembly having a hydrophobic inlet membrane, connected to the housing and capable of allowing one or more substances from the underwater environment to diffuse into the housing. The systems further include a vacuum chamber disposed within the housing, and a mass spectrometer disposed within the vacuum chamber for detecting one or more of the substances. The vacuum chamber may be capable of maintaining a vacuum and is typically connected to the inlet assembly for receiving the one or more substances.

BRIEF DESCRIPTION OF THE DRAWINGS

The following figures depict certain illustrative embodiments of the invention in which like reference numerals refer to like elements. These depicted embodiments may not be drawn to scale and are to be understood as illustrative of the invention and not as limiting in any way.

DETAILED DESCRIPTION OF CERTAIN ILLUSTRATED EMBODIMENTS

The systems and methods described herein include improved chemical analysis systems and improved methods to study and identify dissolved gases and volatile chemicals in the water column, subsurface environments and atmospheric environments.

The systems and methods described herein will now be described with reference to certain illustrative embodiments. However, the invention is not to be limited to these illustrated embodiments which are provided merely for the purpose of describing the systems and methods of the invention and are not to be understood as limiting in anyway.

As will be seen from the following description of certain illustrated embodiments, the systems and methods described herein include, among other things, systems capable of being deployed for long periods of time in oceanic, subsurface and atmospheric environments. The systems are configured for amphibious operation both underwater as well as in the air and under the surface; the systems typically include mass spectrometers to measure low molecular weight gases dissolved in the water and volatile chemicals in air and water, and can move through the ocean, subsurface and atmospheric environment to take samples over a large geographic area. Additionally, these mass spectrometer devices are small and require little power and thereby facilitate the development of sample collection devices that can be placed at a remote location and operated for a substantial period of time from an on-board power supply such as a battery or a fuel cell. Such small and lightweight mass spectrometer devices when combined with low power AUVs (Autonomous Underwater Vehicles) and other manned and un-manned vehicles, can take samples over substantial distances and for a substantial period of time.

Figure 1:
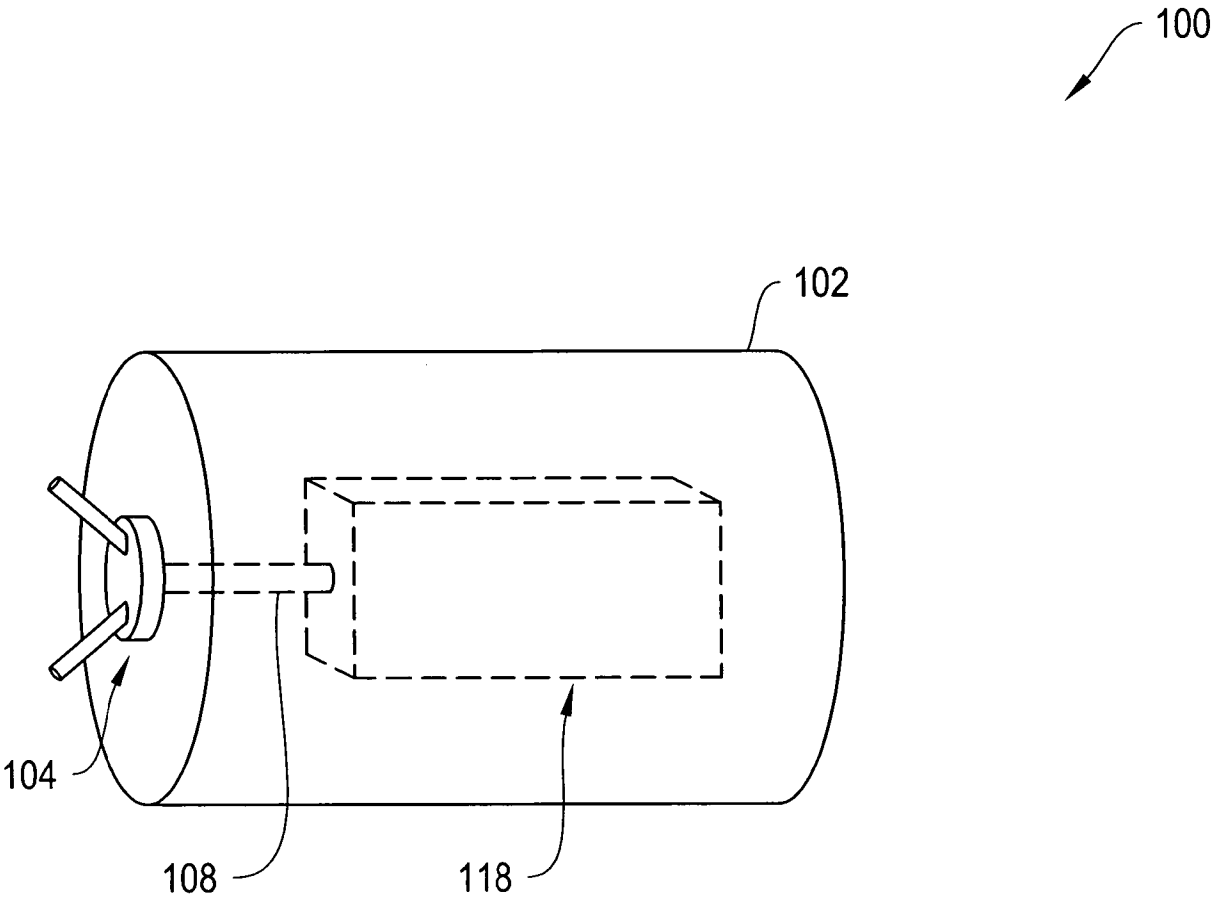
FIG. 1 is a conceptual block diagram of a system for performing a chemical analysis of an underwater environment, according to an illustrative embodiment of the invention.

FIG. 1 is a conceptual block diagram of an exemplary submersible system 100 for performing a chemical analysis of an underwater environment having an inlet assembly 104 and an analyzer 118 disposed in a protective housing 102 and connected to the inlet assembly 104 through an inlet tube 108. When the system 100 is submerged underwater, the inlet assembly 104 allows chemicals from the surrounding water column to diffuse via the inlet tube 108 and into analyzer 118 located in the housing 102.

Figure 2A:
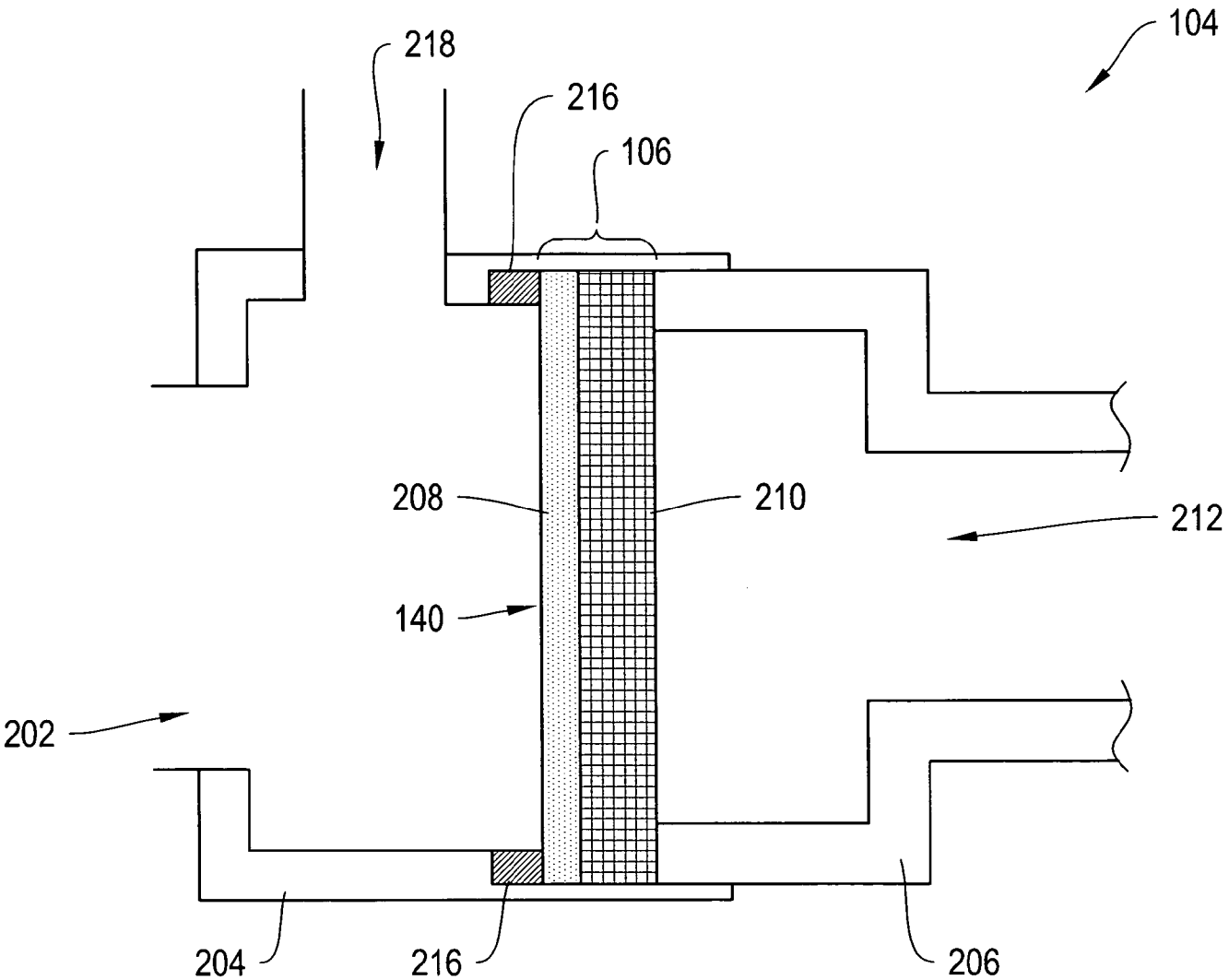
FIG. 2A depicts an exemplary inlet assembly to be used with the system of FIG. 1.

FIG. 2A depicts a more detailed view of an exemplary inlet assembly 104 for use with the system 100 of FIG. 1. The inlet assembly 104 includes an inlet membrane assembly 106 having a surface 140 that is exposed to the water column in the surrounding underwater environment. In certain embodiments, the inlet membrane assembly 106 allows gases dissolved in the water column to diffuse into the housing 102 through the inlet tube 108, while substantially blocking liquid water. In certain embodiments, the inlet membrane assembly 106 allows volatile gases in the air to diffuse into the housing 102 through the inlet tube 108, while substantially blocking water vapor molecules. The inlet membrane assembly 106 includes an inlet membrane 208 for allowing chemicals to permeate through to the analyzer 118 and a backing plate 210 for supporting the inlet membrane 208.

The inlet membrane 208 typically includes water-impermeable or hydrophobic materials for blocking liquid water while allowing dissolved gases to diffuse into the housing 102. In certain embodiments, the inlet membrane 208 includes materials that substantially prevent water vapor from diffusing through the membrane 208. Water and water vapor molecules that diffuse through the membrane 208 and into the analyzer 118 can collide with the gas ions being measured and thereby influence the measured signal. The inlet membrane 208 may include materials whose permeability is fairly insensitive to thermal and/or chemical changes in the underwater environment. In certain embodiments, the inlet membrane 208 includes a thin semi-permeable membrane typically formed from polymer and/or sheet polymer materials. In certain embodiments, the inlet membrane 208 includes polyethylene (LDPE). In other embodiments, the inlet membrane includes at least one of high-density polyethylene (HDPE) and polymethylpentene (PMP). In certain embodiments, the inlet membrane 208 includes material that are selected based at least in part on the nature of the gases of interest being analyzed. The inlet membrane 208 may include at least one of polypropylene, trespaphan GND related polymers, polytetrafluoroethylene, Hostaflon PFA related polymers, polyimino-1-oxohexamethylene, and silicone.

The inlet membrane 208 may also include materials capable of withstanding high water pressures and corrosive effects of sea water. In certain embodiments, the inlet membrane 208 includes materials capable of tolerating high pressure differentials between the external underwater environment and the internal near vacuum conditions in the analyzer 118. In certain embodiments, the inlet membrane 208 includes materials capable of tolerating hydrostatic pressures of about 500 atmospheres on one surface exposed to deep underwater environments and about $10^{-8}$ Torr on the other surface exposed to the internal vacuum within the analyzer 118. Generally, such a pressure differential facilitates the diffusion of dissolved gases across the membrane 208.

The inlet membrane 208 may be sized and shaped as desired depending on the size and shape of the inlet membrane assembly 104 and on the characteristics of the underwater environment. In certain embodiments, the inlet membrane 208 may be sized and shaped to improve tensile strength, increase or decrease permeability, or increase tolerance to damaging underwater environments. In certain embodiments, the inlet membrane 208 is disc shaped and about 0.001 inches thick.

In certain embodiments, the inlet membrane 208 includes any material having a low permeability to water and/or slow permeability rate constants and/or low compressibility and/or high tensile strength without departing from the scope of the invention. The inlet membrane 208 may include materials having high modulus of elasticity, low temperature coefficients and resistance to biofouling.

As illustrated in FIG. 2A, the inlet membrane 208 is positioned on a backing plate 210 for structural support. The backing plate 210 may include any rigid materials such as metals for bearing high hydrostatic pressures in excess of about 500 atmospheres. The backing plate 210 may be sized, shaped and structured to interoperationally fit with the inlet membrane 208 for allowing diffusing chemicals to pass through while reducing or preventing structural damage to the inlet membrane 208. In certain embodiments, the backing plate 210 is formed from a rigid material having perforations for allowing the permeated dissolved gases to pass through into the inlet tube 108. In certain embodiments, the backing plate 210 includes a stainless-steel micro-etched plate. In such embodiments, the backing plate 210 includes a porous stainless-steel plate having small diameter holes of about 0.01 inches. In other embodiments, the backing plate 210 includes an aluminum micro-etched plate.

The inlet membrane 208 in combination with the backing plate 210 may allow diffused gases to pass through while blocking water. In particular, the combination of the inlet membrane 208 and the backing plate 210 is advantageous in that it does not excessively compress or sag due to hydrostatic pressure deferential in deep underwater environments where the pressure can exceed about 500 atmospheres. The inlet membrane 208 also helps minimize unwanted permeability variations as a function of depth.

The inlet membrane assembly 106 may be secured between an inlet cap 204 and an inlet body 206 via a protective layer 216. The inlet cap 204 includes an opening 202 for allowing water to reach the inlet membrane 208. The inlet cap 204 also includes an opening 218 for connecting to other devices connected to the system 100 include sensors and pumps as described in more detail with reference to FIG. 3. The inlet body 206 is typically threaded into a portion of the inlet cap 204 and includes an opening 212 that allows the permeated substances to pass through the inlet tube 108 and into the housing 102. The protective layer 216 may include, among other things, a Teflon washer that helps secure the inlet membrane assembly 106 to the inlet cap 204.

In certain embodiments, one or more components of the inlet assembly 104 include materials capable of mitigating the corrosive effects of sea water. In certain embodiments, the inlet assembly 104 includes substances that are applied as one or more layers of coating for protecting the inlet cap 204, the inlet membrane 208, the backing plate 210 and/or the inlet body 206. At least one of the inlet cap 204 and the inlet body 206 is formed from stainless-steel and/or aluminum.

In certain embodiments, the backing plate 210 interoperationally couples with the inlet cap 204 and/or the inlet body 206 to provide structural support for the inlet membrane 208 and/or suitable openings for allowing the diffusing chemicals to pass. The backing plate 210 may include strips of rigid materials arranged as a louver and held in place by the inlet cap 204 and/or inlet body 206. In certain embodiments, the inlet body 206 and/or the inlet cap 204 compresses under high underwater hydrostatic pressure. In such embodiments, the backing plate 210 having the louver configuration counters the tendency for the inlet membrane 208 from pushing inwards against the backing plate 210. Additionally, the backing plate 210 having a louver-type configuration may allow for a short and continuous diffusion path for substances permeating through the membrane 208, thereby allowing fast diffusion at a wide range of external hydrostatic pressures. The strips of rigid material may include stainless steel strips and/or aluminum strips.

Figure 2B:
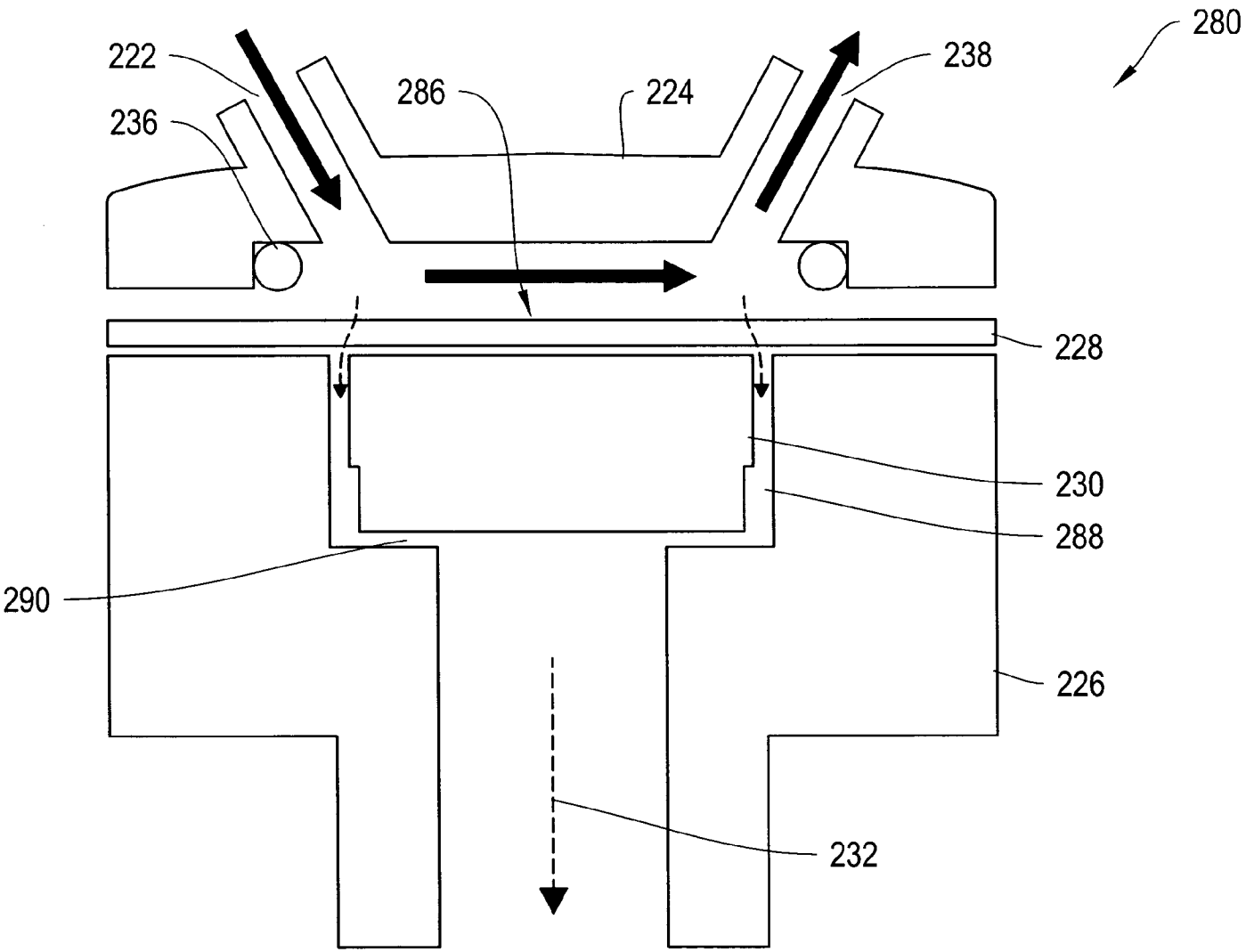
FIG. 2B depicts an exemplary inlet assembly to be used with the system of FIG. 1.
Figure 2C:
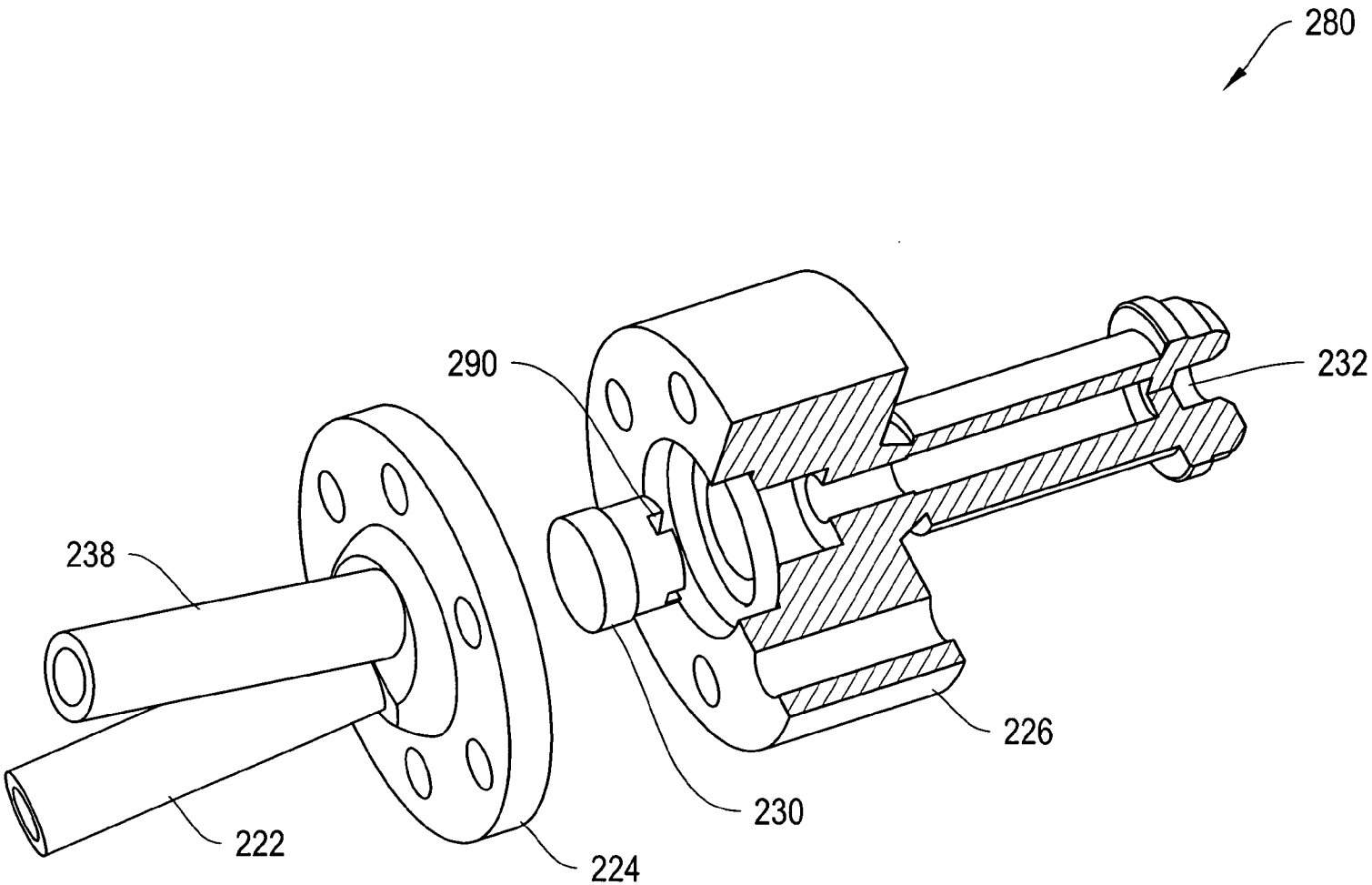
FIGS. 2C and 2D depict a partially assembled inlet assembly of FIG. 2B to be used with the system of FIG. 1, according to an illustrative embodiment of the invention.
Figure 2D:
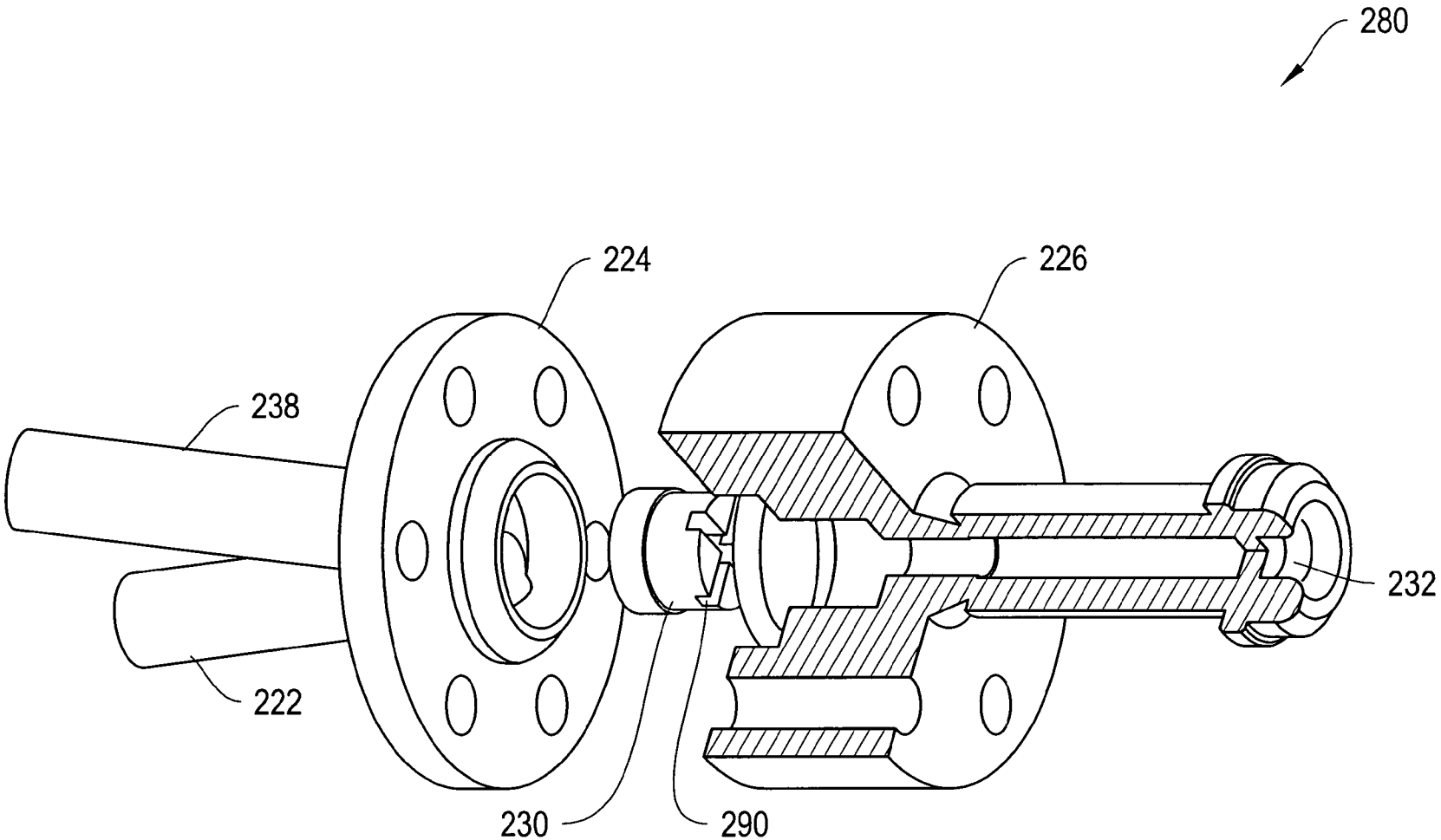

In certain embodiments, the inlet assembly 104 is configured to form a small gap between the backing plate 210 and the inlet body 206 to allow dissolved chemicals to diffuse into the system 100 while keeping stresses on the inlet membrane 208 to a minimum. Dissolved chemicals diffusing through the inlet membrane 108, pass through the gap and into the analyzer 118. FIGS. 2B, 2C and 2D depict such an exemplary inlet assembly 280 for use with the system 100 of FIG. 1. The inlet assembly 280 includes an inlet membrane assembly 286 having an inlet membrane 228 and backing plate 230 and secured between an inlet cap 224 and an inlet body 226.

The inlet cap 224 includes an opening 222 for allowing water to reach the surface of the inlet membrane 228. The inlet cap 224 also includes an opening 238 for removing water from the surface of the inlet membrane 228 and for connecting to other devices including sensors and pumps as described in more detail with reference to FIG. 3. The inlet cap 224 may be formed from materials similar to those used in inlet cap 204 of FIG. 2A. The inlet cap 224 is secured on the inlet membrane 228 either directly or indirectly through a protective layer 236. In such embodiments, the protective layer 236 includes one or more O-rings, washers, backing nuts and sealants for providing a secure connection between the inlet cap 224 and the inlet membrane 228.

The inlet membrane 228 may be similar to inlet membrane 208 of FIG. 2A and is capable of allowing certain desired chemicals to diffuse into the system 100 while substantially blocking liquid water. In certain embodiments, the inlet membrane 228 is about 20 to about 60 microns thick. The inlet membrane 228 may include materials having desirable characteristics of at least one of water exclusion, relative permeability to chemicals of interest, speed of permeability, mechanical strength, permeability temperature coefficient and resistance to bio-fouling.

The inlet body 226 typically aligns and couples with the inlet cap 224 to secure the inlet membrane 228 therebetween, and includes an opening 232 that connects to the inlet tube 108. In certain embodiments, the inlet body 226 includes a recess for accommodating the backing plate 230. The backing plate 230 may have a width less than the width of the recess in the inlet body 226; when placed in the recess, the backing plate 230 and the inlet body 226 may be separated by a small gap 288. As more clearly seen in FIGS. 2C and 2D, the backing plate 230 may further include one or more slots 290 that extend along a surface of the backing plate 230 that faces the opening 232 of inlet body 226. The slots 290 may extend, along the surface of the backing plate 230 facing the opening 232, from one or more sides towards the center. The gap 288 in combination with the slots 290 may provide a path for diffusing chemical substances from the inlet membrane 228 to the opening 232 and inlet tube 108. In certain embodiments, the gap 288 is less than about 25 microns thick. The inlet body 226 may be formed from materials similar to inlet body 206 of FIG. 2A. In certain embodiments, the backing plate 230 is cylindrically shaped as shown in FIGS. 2C and 2D. The backing plate 230 may be formed from material similar to inlet body 210 of FIG. 2A.

In certain embodiments, the backing plate 230 includes one or more slots along a side surface such that gap 288 is discontinuous around the perimeter of the backing plate 230. In such embodiments, the one or more slots along the side surface may be aligned with slots 290 to provide a path for diffusing chemical substances from the inlet membrane 228 to the opening 232 and inlet tube 108.

The inlet assembly 104 may be partially or completely located outside the housing 102. Referring to FIG. 1, the inlet assembly 104 is connected to an analyzer 118 via an inlet tube 108. In certain embodiments, the inlet assembly 104 is configured such that a portion of the inlet tube 108 that connects the inlet assembly 104 with the housing 102 is located outside the housing 102. In such embodiments, the inlet tube 108 includes materials capable of mitigating the corrosive effects of seawater.

In certain embodiments, the inlet tube 108 includes a flexible stainless steel tube having a diameter of about 2 mm. The inlet tube 108 may enter the housing 102 through a penetration aperture of about 0.6 inches in diameter. In certain embodiments, portions of the inlet tube 108 that are located outside the housing 102 include materials capable of withstanding high hydrostatic pressures greater than about 500 atmospheres and high pressure differentials between the external and internal surfaces without collapsing. In such embodiments, the inlet tube 108 includes one or more additional components such as O-rings, washers, backing nuts and sealants for providing a secure connection between the inlet assembly 104 and the vacuum chamber 110. In certain embodiments, a portion of the inlet tube 108 resides in the interior of the housing 102 and include thin-walled corrugated tubing. In such embodiments, the inlet tube 108 are made of light materials that are capable of withstanding about one atmosphere of pressure within the housing 102. In certain embodiments, the inlet tube 108 includes flexible and detachable tubes for allowing the disassembly of the system 100 during maintenance.

Figure 3:
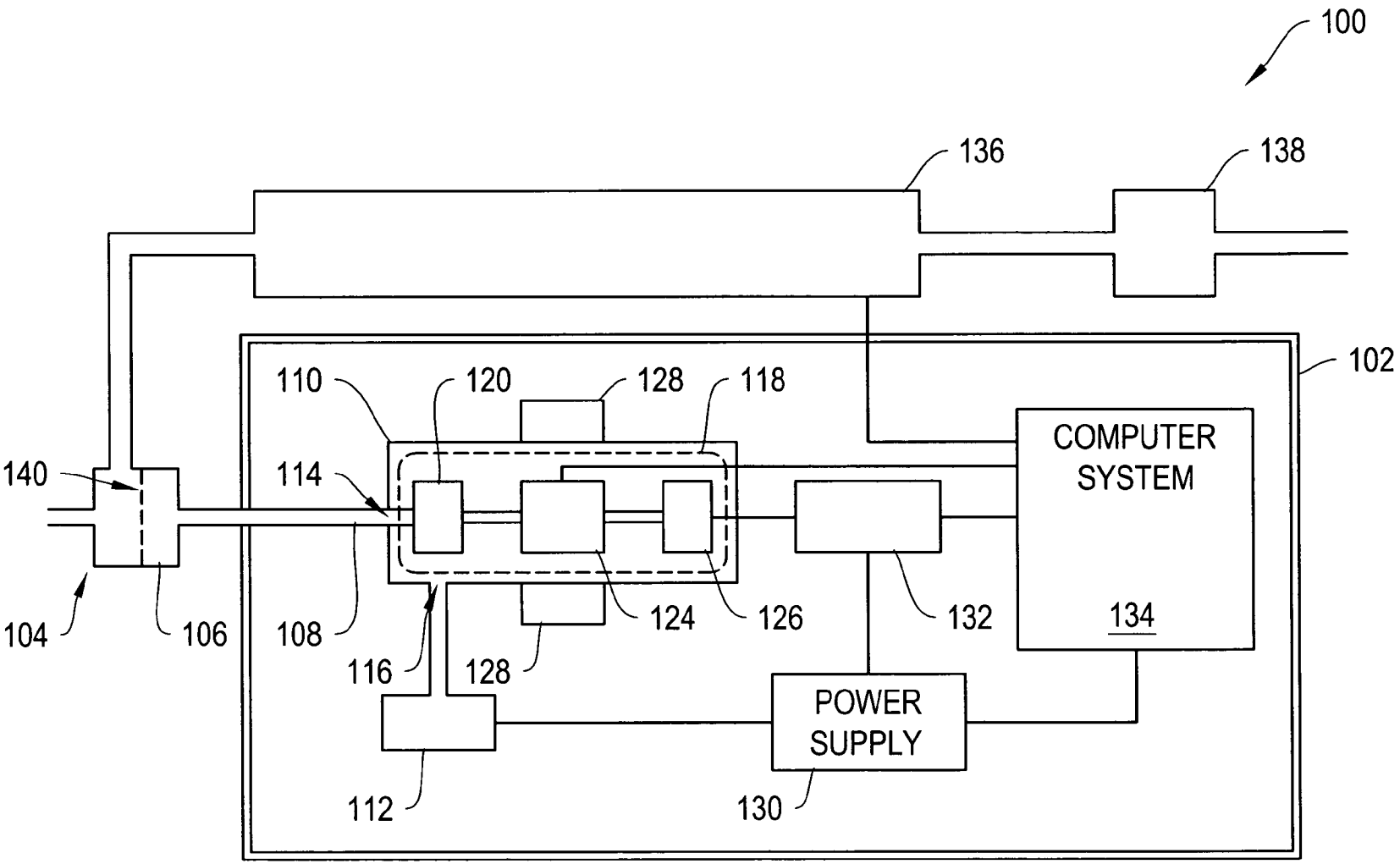
FIG. 3 is a more detailed conceptual block diagram of the system for performing a chemical analysis of an underwater environment of FIG. 1.

Turning to FIG. 3, a more detailed view of system 100 is depicted, according to an illustrative embodiment of the invention. The system 100 includes the inlet assembly 104 of FIG. 1, housing 102 with analyzer 118, sensor 136 and pump 138. The housing 102 includes a vacuum chamber 110 connected to the inlet assembly 104 via an inlet tube 108. The vacuum chamber 110 is connected to a vacuum pump 112 for generating a vacuum therein. The vacuum chamber 110 houses an analyzer 118 that includes an ionizer 120, a mass selector 124 and a detector 126. A permanent magnet assembly 128 is fitted around the vacuum chamber 110 for generating a magnetic field in the analyzer 118. The detector 126 is connected to an electrometer 132 for measuring signals detected by the detector 126. The electrometer 132 is connected to a computer system 134. The computer system 134 is also connected to the mass selector 124. The computer system 134 is further connected to an external sensor 136 and a pump 138 for acquiring data from the sensor 136 and operating the pump 138. When submerged, sensor 136 measures characteristic of the surrounding water column. Pump 138 cycles water through the inlet assembly and the sensor 136. The housing 102 also includes a power supply 130 for providing power to operate the computer system 134, the electrometer 132 and the vacuum pump 112.

In certain embodiments, during operation, the inlet membrane assembly 106 allows gases dissolved in the water column to diffuse into the housing 102 through the inlet tube 108, while substantially blocking liquid water. The dissolved gases pass through the inlet tube 108, into the vacuum chamber 110 and enter the ionizer 120, which ionizes the gaseous molecules and generates ions. A magnetic field is generated by the permanent magnet assembly 128 positioned on the vacuum chamber 110 and an electric field is generated within the mass selector 124. The electric and magnetic fields in combination influence the movement of the ions. The ions are accelerated along predetermined trajectories from the ionizer, through the mass selector 124 towards the detector 126. Based in part on their mass-to-charge ratios, they follow different trajectories through the mass selector 124 and strike the detector 126. The detector 126 generates an electric current in response to the striking ions. The electrometer 132 senses this electric current and outputs a voltage in response thereto. The computer system 134 converts the electrometer output voltage to a digital signal which is stored and analyzed. Additionally, the sensor 136 located outside the housing 102 may be a CTD sensor for measuring conductivity, temperature and depth of the underwater environment. The sensor 136 is typically connected in series with the inlet assembly 104 and a pump 138. The pump 138 circulates water through the inlet assembly 104 so that a new supply of water continuously made available at the inlet membrane surface 140.

The housing 102 includes a waterproof enclosure and helps prevent damage to the internal components from water. In one embodiment, the housing 102 may be formed from suitable waterproof or water impermeable material. In particular, the water proof material may be formed from fine polyester/nylon blends, rubber or plastic, hydrophobic material or other non-porous materials and may include suitable sealants. The housing 102 may include at least one layer of NEOPRENE® or GORETEX®. In other embodiments, the housing 102 may formed by coating a layer of waterproof material on a non-waterproof material. The housing 102 may also have one or more layers of material that may be impermeable to other liquids and gases. The housing 102 may also have of one or more layers of material that may be resistant to high temperature and pressure (e.g., high-temperature and high pressure at ocean depths of greater than 300 m). In other embodiments, the housing 102 may comprise of one or more layers of material that may be resistant to corrosive and abrasive substances. In still other embodiments, the housing 102 may comprise of one or more layers of material that may be resistant to abuse from wildlife. In certain embodiments, a portion of the housing 102 may be formed from a transparent material to allow light rays to pass through. The housing 102 substantially prevents environmental damage to the components of the system 100 and its various internal components including the sensitive electronic circuitry. In certain embodiments, the housing 102 is adapted to for atmospheric or subsurface applications. In such embodiments, the housing 102 includes light materials configured to tolerate atmospheric and near atmospheric pressures.

Figure 4B:
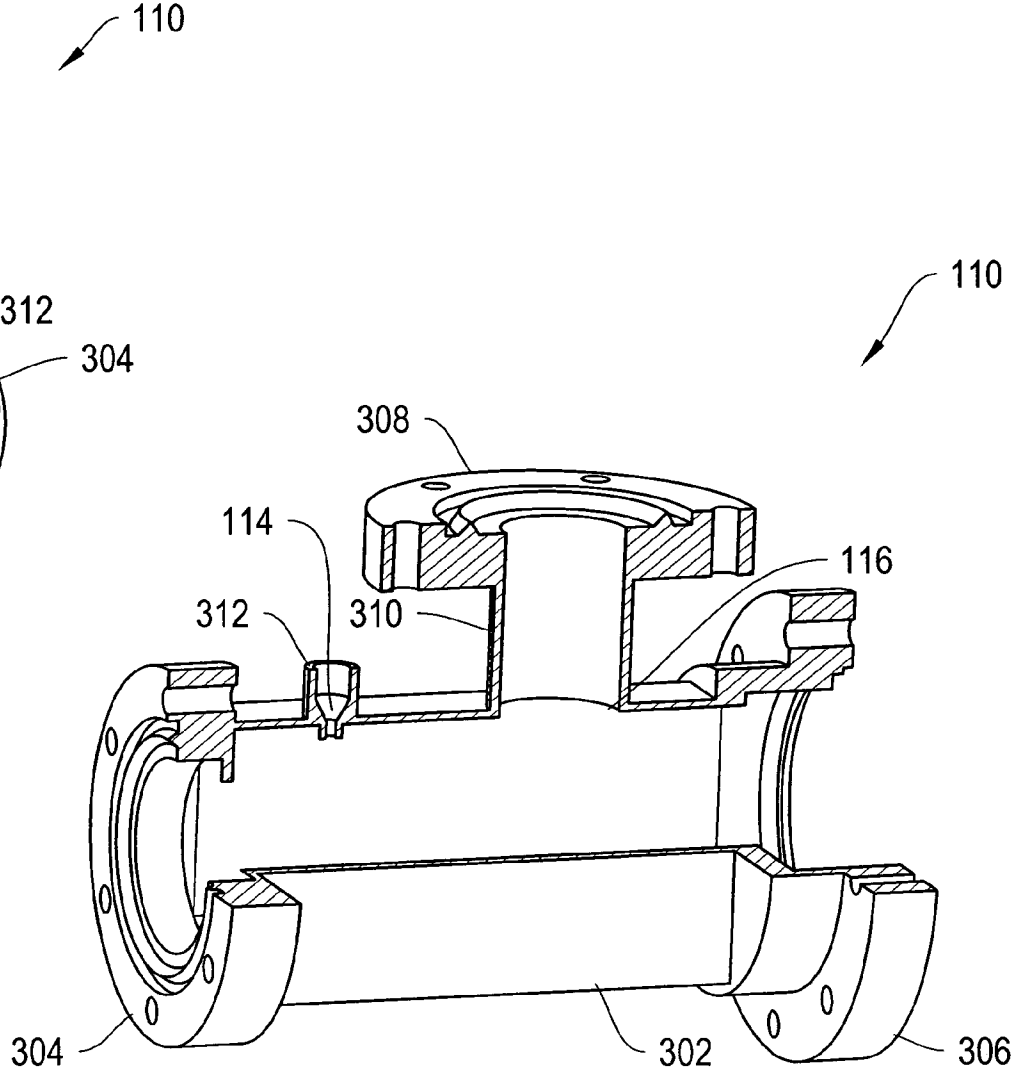
FIGS. 4A and 4B depict a vacuum chamber to be used with the system of FIG. 1, according to an illustrative embodiment of the invention.
Figure 4A:
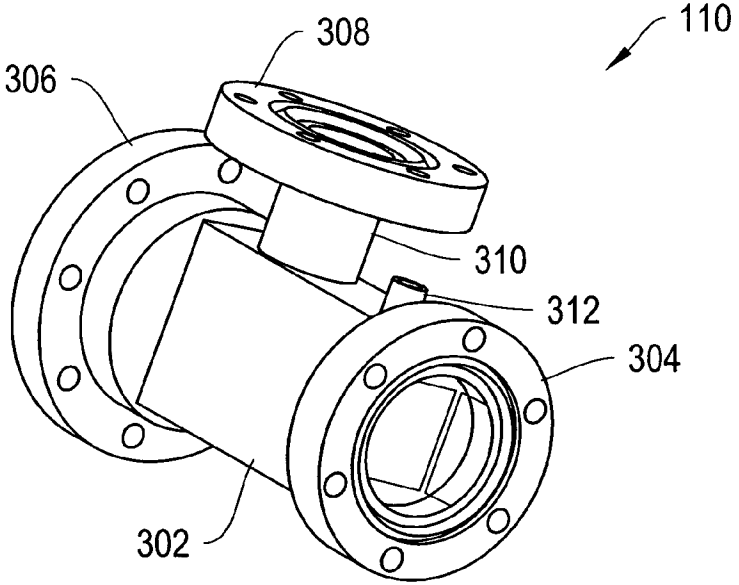

FIGS. 4A and 4B depict a vacuum chamber 110 to be used with the system of FIG. 1, according to an illustrative embodiment of the invention. In particular, FIG. 4A shows a three-dimensional view of the vacuum chamber 110 and FIG. 4B shows a cut-away view of the inside of the vacuum chamber 110. The vacuum chamber 110, includes a chamber enclosure 302, a first flange 304, a second flange 306 and a third flange 308. The chamber 110 also includes an input port 312 at a sample inlet aperture 114, and a vacuum port 310 at a vacuum aperture 116. In certain embodiments, the input port 312 is sized and shaped to mate with the inlet tube 108 of FIG. 1. The third flange 308 is connected to the vacuum aperture 116 through vacuum port 310. The third flange 308 may be connected to the vacuum pump 112 of FIG. 1.

In certain embodiments, vacuum chamber 110 including the chamber enclosure 302 is formed from stainless-steel material. One or more components of the vacuum chamber 110 may include any material having desirable measures of weldability, low magnetic permeability, chemical inertness and mechanical strength without departing from the scope of the invention. The chamber enclosure 302 is sized and shaped to fit a mass spectrometer for use in underwater environments. The chamber enclosure 302 may be a box section having dimensions of about 2 inches by about 3 inches by about 0.05 inches. The chamber enclosure 302 may be welded to the first flange 304 on one end. In certain embodiments, the first flange 304 is a 2¾ inch conflat flange. The chamber enclosure 302 may also be welded to the second flange 306. In certain embodiments, the second flange 306 is a 3⅜ inch diameter O-ring type flange. The chamber enclosure 302 includes a vacuum port 310 welded along the vacuum aperture 116 and attached to a third flange 308. The third flange 308 may be a 2¾ inch diameter conflat flange. In certain embodiments, at least one of the flanges 304, 306 and 308 is formed from at least one of stainless steel and aluminum.

Figure 5:
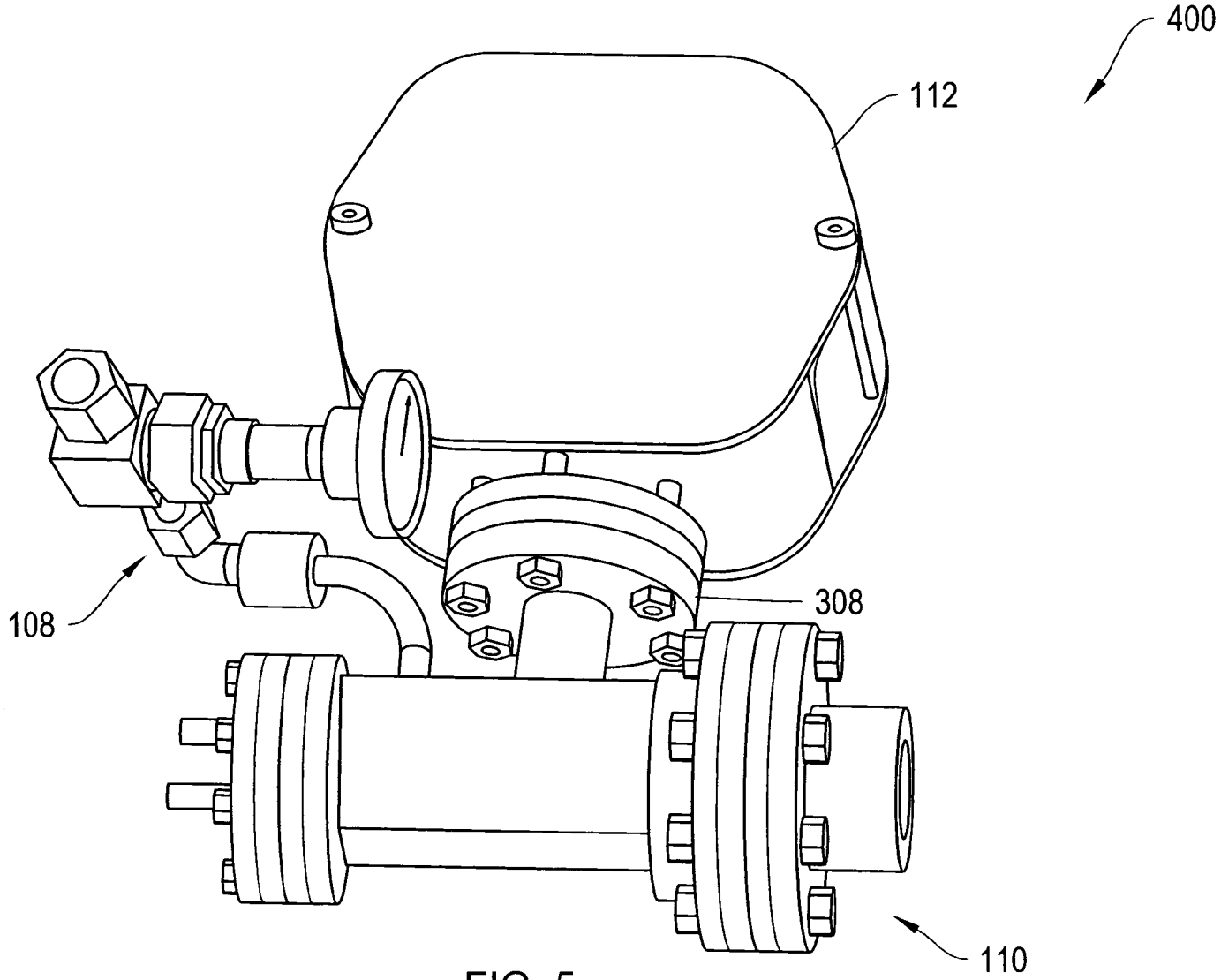
FIG. 5 depicts an assembled vacuum system, according to an illustrative embodiment of the invention.

FIG. 5 depicts an assembled vacuum system 400, according to an illustrative embodiment of the invention. In particular, the assembled vacuum system 400 includes a vacuum chamber 110, an inlet tube 108 and a vacuum pump 112. The inlet tube 108 includes one or more components that are connected to each other including valves, regulators, connecting tubes and connectors. The vacuum pump 112 includes a flange assembly for mating with the third flange 308 of the vacuum chamber.

In certain embodiments, the vacuum pump 112 includes an ion pump. The ion pump may be a non-evaporable getter (NEG) ion pump. The NEG-ion pump size and conductance rate may be matched to an estimated rate of gaseous molecules entering the vacuum chamber 110 and the rate of ionized gaseous molecules generated by the ion source 120 of FIG. 3. In certain embodiments, the vacuum pump 112 includes at least one diode type ion pump. In certain embodiments, the vacuum pump 112 includes at least one diode type ion pump connected with a turbo-molecular pump. In certain embodiments, the vacuum pump 112 includes one or more components capable of pumping noble gases and capable of maintaining ultra-high vacuum at low power supply. In such embodiments, the vacuum pump 112 includes a triode type ion pump with a non-evaporable getter. The vacuum pump 112 may include any ion pump having no moving parts and tolerant to impact and vibration without departing from the scope of the invention. The vacuum pump 112 may be powered by power supply 130 and optionally connected to computer system 134 of FIG. 3. In certain embodiments, the vacuum pump 112 is powered at an operating voltage of about 4000-5000V DC. In certain embodiments, the vacuum pump 112 is connected to a high-gain DC-DC converter which in turn is connected to the power supply 130. In such embodiments, the DC-DC converter may be capable of accepting about 12 volts from a power supply 130 and generating about 3000 volts. The vacuum pump 112 may be configured to draw less than about 200 μA of electric current and thereby consume about 0.6 watts of electric power. In certain embodiments, the vacuum pump 112 and the DC-DC converter, together, typically consume less than about 2 watts of electric power.

Figure 6:
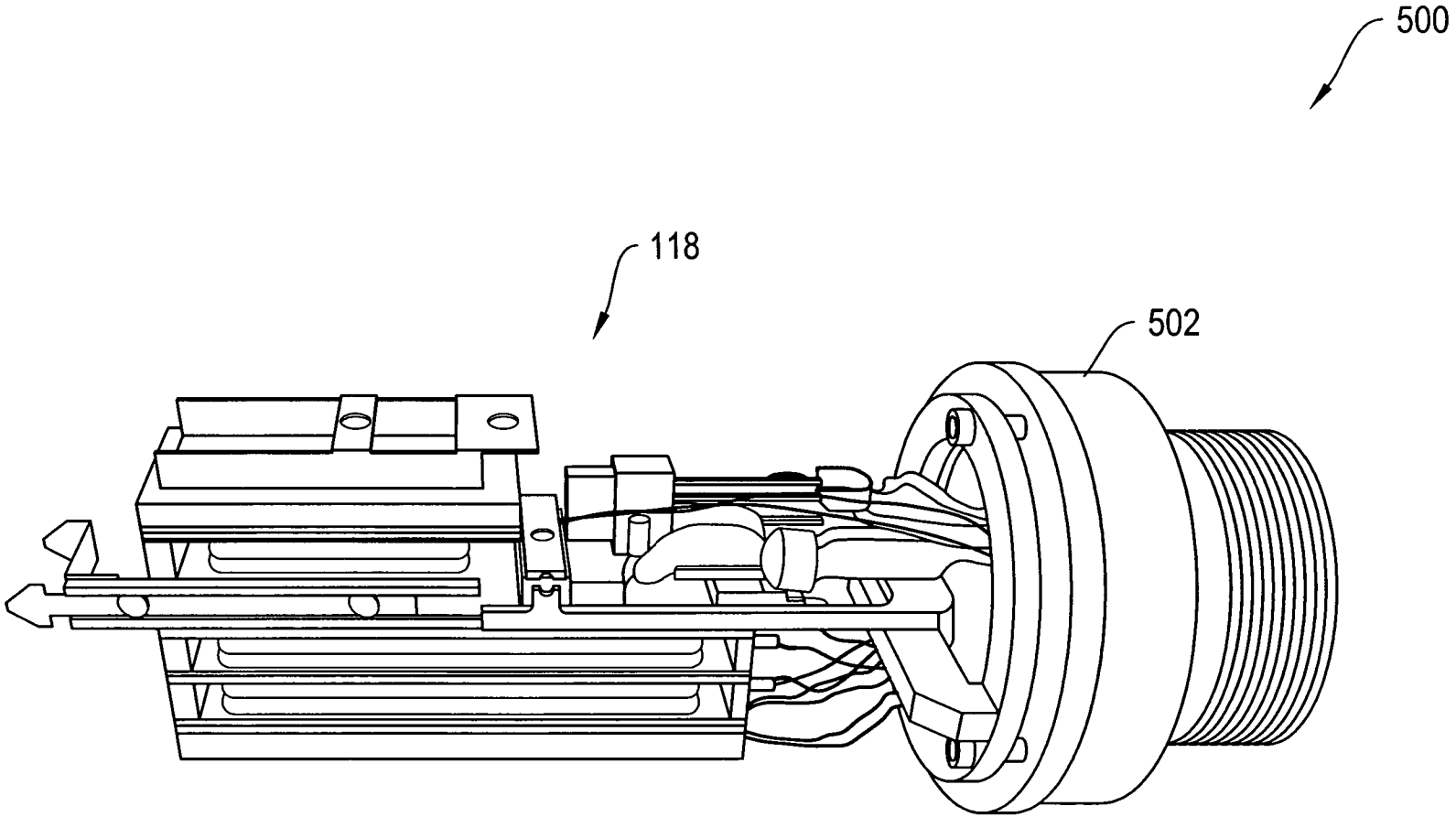
FIG. 6 depicts a mass spectrometer to be used with the system of FIG. 1, according to an illustrative embodiment of the invention.

In certain embodiments, the first flange or the second flange couples with an analyzer assembly for holding the analyzer 118 in position within the vacuum chamber 110. FIG. 6 depicts an analyzer 118 to be used with the system of FIG. 1, according to an illustrative embodiment of the invention. In particular, the analyzer 118 is attached to an analyzer flange 502. In certain embodiments, the analyzer flange 502 couples with the second flange 306 of FIGS. 4A and 4B. A Teflon O-ring may be placed between the analyzer flange 502 and the second flange 306 for providing a pressure seal. Teflon is advantageous for use in an O-ring or other sealing components due to its relative low permeability to gases, its ability to withstand high temperatures and low costs. Other materials having one or more of these properties may be selected for use in sealing components without departing from the scope of the invention.

In certain embodiments, as shown in FIGS. 3 and 6, the analyzer 118 includes an ion source 120, a mass selector 124 and a detector 126. The analyzer 118 may include a mass analyzer capable of separating and detecting gases based on their masses. In certain embodiments, the analyzer 118 includes a Miniature Mass analyzer made by Monitor Instruments Company, LLC, Cheswick Pa. Analyzer 118 may include mass analyzers described in U.S. Pat. Nos. 5,304,799, 6,815,674 and 6,617,576, each of which are incorporated herein by reference in their entirety. In certain embodiments, the analyzer 118 includes other cycloidal mass spectrometers without departing from the scope of the invention. In certain embodiments, the analyzer 118 includes a quadrupole mass analyzer. The analyzer 118 may include a plurality of quadrupole mass analyzers arranged in any desired combination. In alternative embodiments, the analyzer 118 may include other mass spectrometers such as differential mass spectrometers.

The analyzer 118 may be capable of separating substances having masses less than about 50 a.m.u. In certain embodiments, the analyzer 118 may be capable of separating substances having masses in the range of about 2 a.m.u to about 50 a.m.u. In certain embodiments, the analyzer 118 may be capable of separating substances having masses in the range of about 2 a.m.u. to about 200 a.m.u. In certain embodiments, the analyzer 118 may be capable of separating substances having masses in the range of about 2 a.m.u. to about 350 a.m.u. The analyzer 118 may be capable of separating substances having masses greater than 350 a.m.u.

During operation, gas molecules that permeate through the inlet assembly 104 and the inlet tube 108 enter the ion source 120 in the vacuum chamber 110 through the sample inlet aperture 114. In certain embodiments, the ion source 120 includes one or more heated tungsten filaments capable of generating and emitting electrons. In certain embodiments, the ion source 120 includes any filament having a desired work function such that electrons are emitted at a lower temperature than Tungsten. In certain embodiments, the ion source 120 includes one or more filaments formed from at least one of alloys and coatings of iridium, rhenium, thorium and yttrium. The ion source 120 may additionally include one or more electrodes operated at desired voltages and arranged such that the emitted electrons are accelerated in the electric field generated by the electrodes. These accelerated electrons may collide with the gas molecules and thereby ionize them and generate ionized gas molecules. In certain embodiments, the ion source 120 further includes one or more electron traps for collecting free electrons or other undesirable ions. The ion source 120 also includes one or more repeller plates operated a particular voltage for repelling any desired ions from the ion source 120 and into the mass selector 124. The mass selector 124 may include one or more injector plates having a voltage lower than that of the repeller plates for allowing the ions to move from the ion source 120 to the mass selector 124.

In certain embodiments, the ion source 120 is selected based at least in part on the weight of the molecules being ionized. In certain embodiments, the ion source 120 includes components that are configured to perform ionization techniques to ionize high molecular weight chemicals. In such embodiments, the ionization techniques include at least one of cold cathode ionization and matrix-assisted laser disorption (MALDI).

In certain embodiments, the mass selector 124 includes a plurality of accelerator plates for generating a variable electric field within the analyzer 118. The permanent magnet assembly 128, detailed in FIGS. 7 and 8, generates an orthogonal magnetic field within the analyzer 118. The crossed variable electric and fixed magnet fields generated within the mass selector 124 cause the ionized molecules to follow curved trajectories. The trajectories for ions having different masses may be adjusted based on the value of the electric and magnetic fields, thereby separating the ions based on their mass-to-charge ratios. In particular, the crossed electric and magnetic fields cause the accelerating ions to follow trochoidal trajectories. These trajectories loop in on themselves to provide for a compact ion path and thereby reduce the size of the analyzer 118. Additionally, the trochoidal trajectories has an inherent property of direction and velocity focusing, thereby making the analyzer 118 less sensitive to misalignment and vibration. In certain embodiments, the mass selector 124 is capable of separating ions having masses of approximately 2 amu to about 150 amu, thereby allowing the separation of dissolved biogenic gases, atmospheric gases, light hydrocarbons and many isotopes. The separated ions may or may not strike one or more detectors 126 placed along their path depending on the selected value of the electric and magnetic fields.

In certain embodiments, the detector 126 includes one or more detectors having low power supply requirements, high stability and reduced need for frequent re-calibration. In such embodiments, the detector 126 includes Faraday cup detectors. The detector 126 may include other ion detectors positioned along the ion's trajectory and capable of detecting ions without departing from the scope of the invention. In certain embodiments, the detector 126 includes an electron multiplier. In certain embodiments, the detector 126 includes a Faraday cup in combination with an electron multiplier. The detector 126 may include any number of suitable detectors to provide desired levels of linearity in data, stability in time, power consumption and limits of detection. In certain embodiments, the detector 126 includes a plurality of Faraday cup detectors. In such embodiments, the plurality of Faraday cup detectors are placed in fixed positions to allow for improved precision in gas and isotope ratio estimations.

Figure 8:
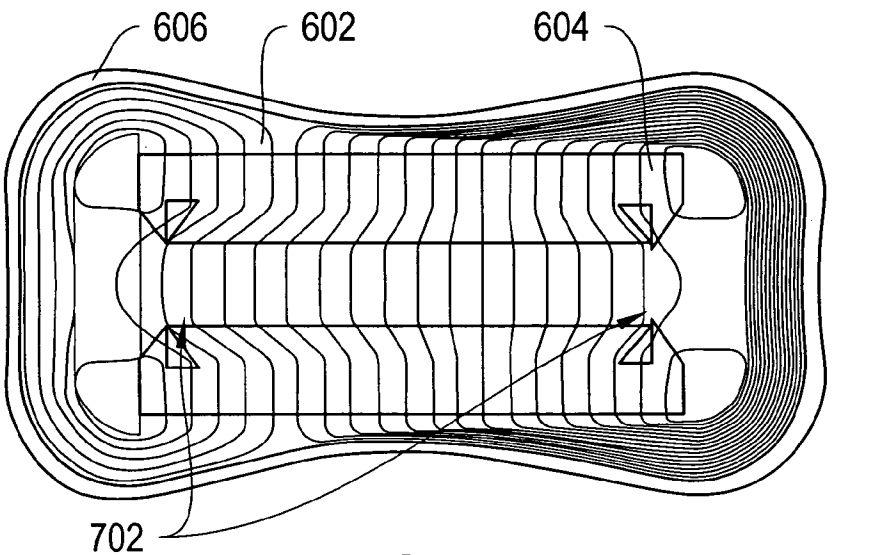
FIG. 8 is a top view of a permanent magnet assembly, showing the magnetic field lines, according to an illustrative embodiment of the invention.
Figure 7:
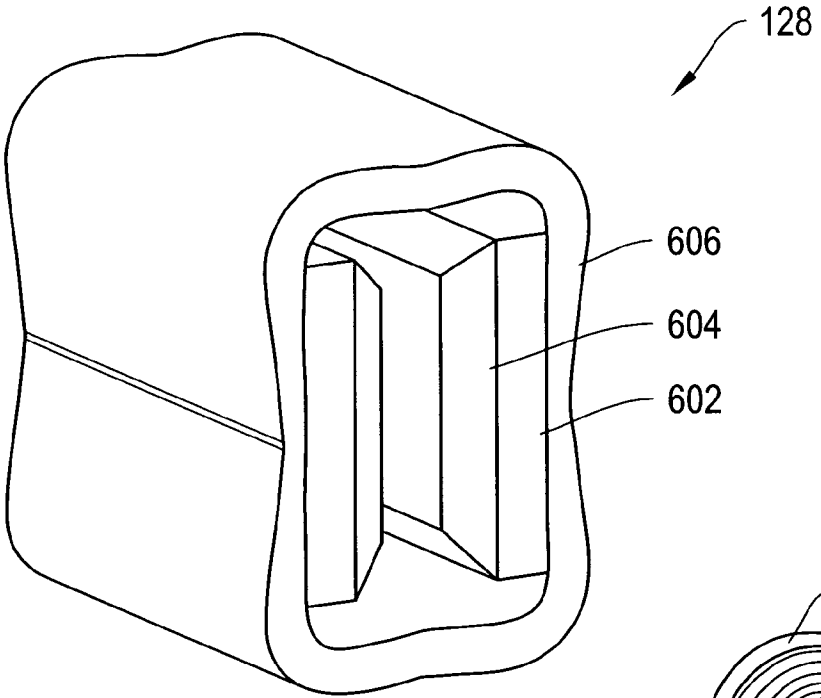
FIG. 7 is a three-dimensional view of a permanent magnet assembly, according to an illustrative embodiment of the invention.

FIGS. 7 and 8 depict a permanent magnet assembly 128 for generating a homogeneous magnetic field within the analyzer 118. FIG. 7 is a three-dimensional view of a permanent magnet assembly 128, according to an illustrative embodiment of the invention. In particular, the permanent magnet assembly 128 includes two magnetic members 602, pole pieces 604 and a carrier material 606. The magnetic members 602 are placed in between the carrier material 606 and two pole pieces 604. In particular, a pair including a pole piece 604 and a magnetic member 602 is attached to an internal wall of a carrier material 606. Another pair including a pole piece 604 and a magnetic member 602 is attached to another internal wall of the carrier material 606 such that there is an air gap between the two pole pieces 604. Magnetic field lines 702 curve from one magnetic member 602 to another and follow substantially straight and parallel lines through the air gap between the pole pieces 604.

In certain embodiments, the carrier material 606 is sized and shaped to maximize the flux, or the number of magnetic field lines, through the air gap between the pole pieces 604. The carrier material 606 include low carbon steel. The carrier material 606 may include other light weight materials having high magnetic permeability without departing from the scope of the invention. In certain embodiments, the pole pieces 604 are sized and shaped to maximize homogeneity of the magnetic field in the air gap. In particular, the pole pieces 604 are tapered near one or more edges to reduce the curving of magnetic field lines and fringing effects at the edges. The pole pieces 604 include low carbon steel. The pole pieces 604 may include other light weight materials having high magnetic permeability without departing from the scope of the invention. In certain embodiments, the magnetic members 602 are rare earth materials. The magnetic member 602 include one or more slabs of NdFeB material and/or an allow of samarium cobalt having dimensions of about 5 inches by about 3 inches by less than about 1 inch. The permanent magnet assembly 128 is shaped to fit over the vacuum chamber 110.

The permanent magnet assembly 128 depicted in FIGS. 7 and 8 is provided as an illustrative embodiment merely for the purpose of describing the analyzer 118 and is not to be understood as limiting in anyway. In particular, the permanent magnet assembly 128 may include at least one of asymmetric and symmetric permanent magnets positioned near the mass selector 124. In one embodiment, the permanent magnet assembly 128 includes a symmetrical toroidal shaped permanent magnet wrapped around at least one of the vacuum chamber and the mass selector 124.

Figure 9B:
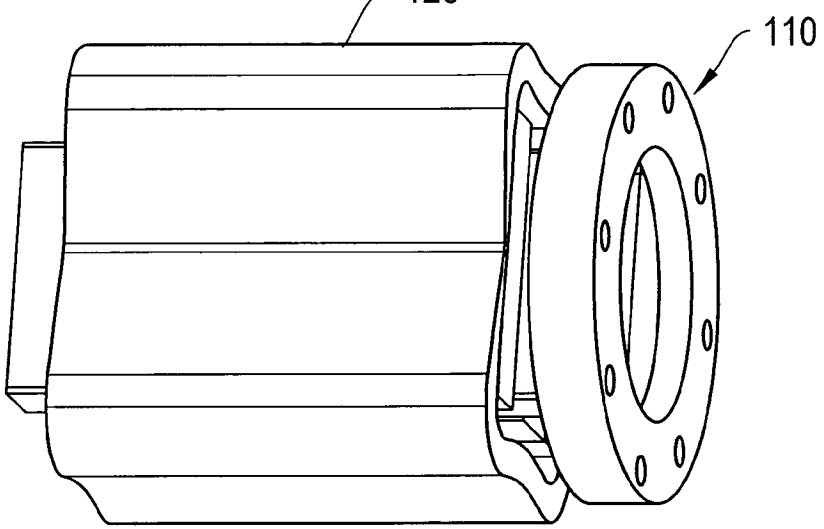
FIGS. 9A-9C depict the permanent magnet assembly installed on a vacuum chamber, according to an illustrative embodiment of the invention.
Figure 9C:
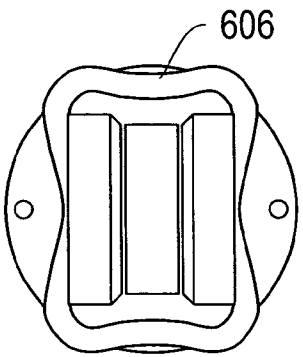
Figure 9A:
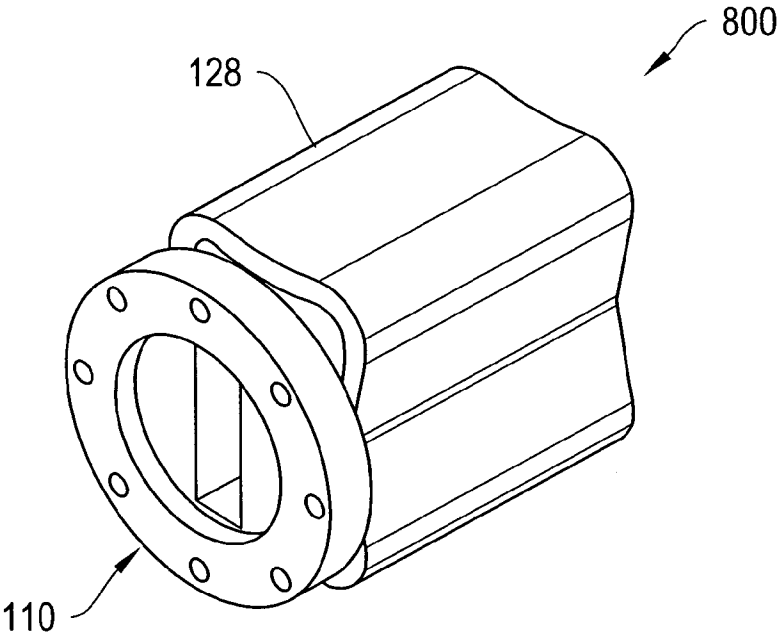

FIGS. 9A-9C depict the permanent magnet assembly installed on a vacuum chamber, according to an illustrative embodiment of the invention. In particular, the permanent magnet assembly 128 fits around the vacuum chamber 110 such that the chamber enclosure 302, as shown in FIGS. 4A and 4B, is positioned in the air gap in between the two pole pieces 604 of the permanent magnet assembly 128. The permanent magnet assembly 128 generates a substantially homogeneous magnetic field within the vacuum chamber 110. As noted earlier, the magnetic field in combination with an orthogonal electric field set up by the mass selector 124 influences the movement of electrically charged particles such as ions. In certain embodiments, the vacuum chamber 110 includes a vacuum port 310 and an input port 312. In such embodiments, the permanent magnet assembly 128 fits along a portion of the chamber enclosure 302 such that it overlaps the vacuum port 310 or the input port 312.

Figure 10:
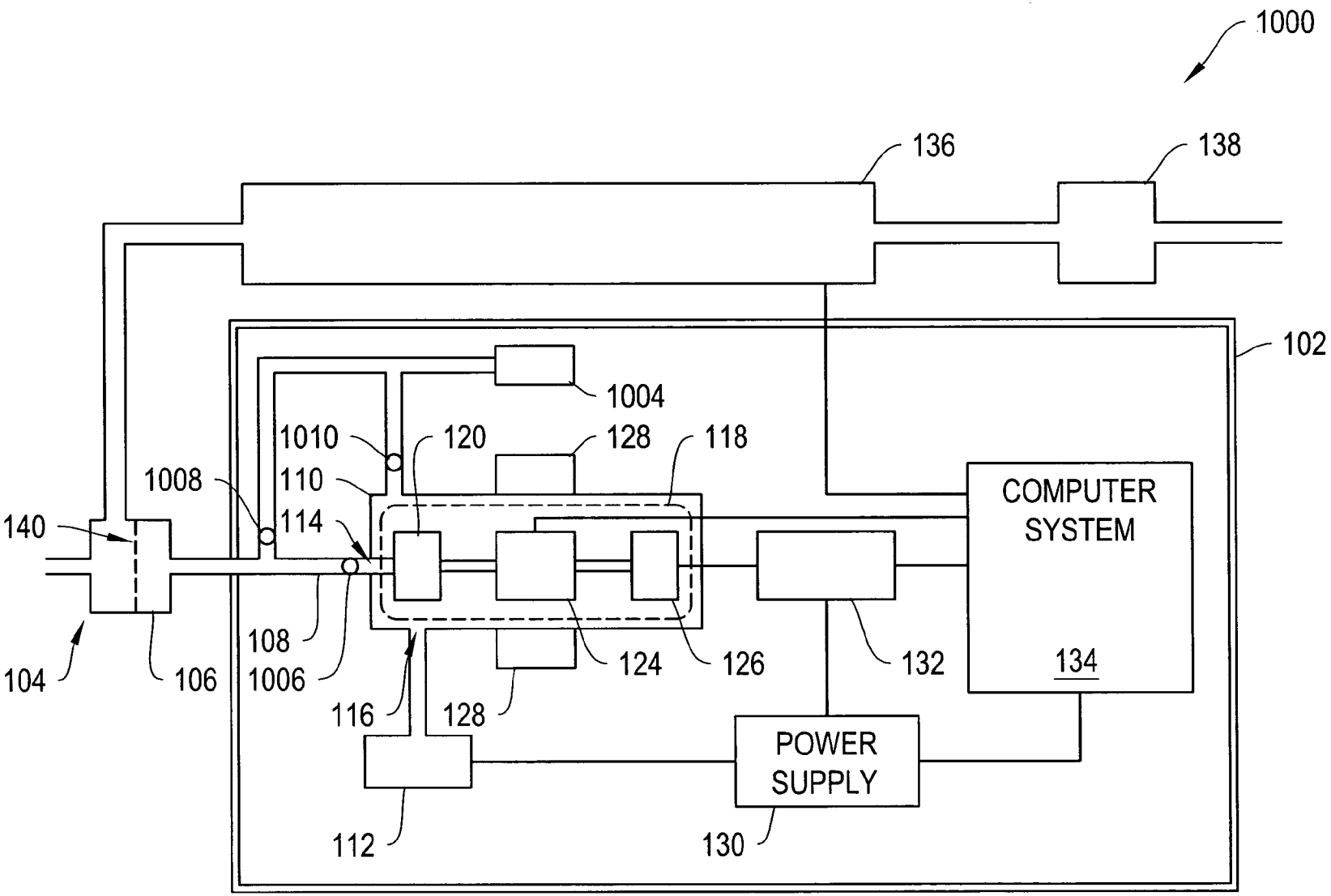
FIG. 10 is a detailed conceptual block diagram of the system for performing a chemical analysis of an underwater environment similar to FIG. 3.

FIG. 10 depicts another embodiment of the system depicted in FIG. 3, In particular, FIG. 10 shows a system 1000 that additionally includes an external roughing pump 1004, an inlet valve 1006, a high vacuum valve 1008 and a crossover valve 1010. The valves 1006, 1008 and 1010 in combination with the roughing pump 1010 help maintain vacuum conditions during operation as well as during storage for extended periods of time. FIGS. 11A-11D depict in more detail the operational and storage modes of the system 1000.

Figure 11A:
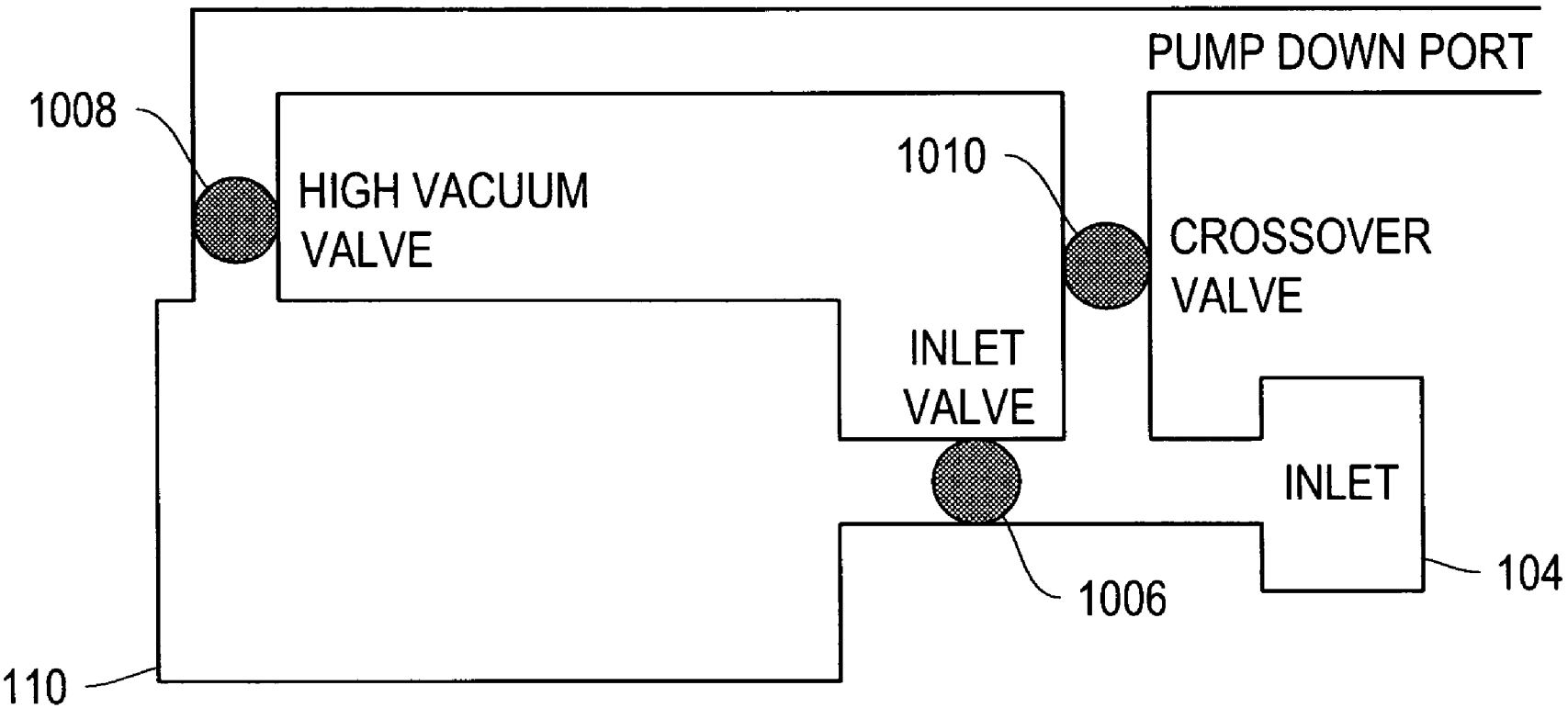
FIGS. 11A-11D depict operational modes of the system of FIG. 10, according to an illustrative embodiment of the invention.

FIG. 11A depicts the operation of the valves of system 1000 in sleep or storage mode, according to an illustrative embodiment of the invention. The inlet valve 1006 is connected between the inlet system 104 and the vacuum chamber 110. The high vacuum valve 1008 is connected between the vacuum chamber 110 and an external roughing vacuum pump that is shown in more detail in FIGS. 11B and 11C. The crossover valve 1010 is connected between the inlet system 104 and the external roughing pump. As depicted in FIG. 11A, during sleep or storage mode, each of the valves 1006, 1008 and 1010 are in a closed position. The closed valves 1006 and 1008 seals the vacuum chamber 110 and helps maintain low-pressure conditions therein during storage. The crossover valve 1010 closes the connection between the inlet system 104 and the external roughing pump.

In certain embodiments, at least one of the valves 1006, 1008 and 1010 is an electrically activated solenoid valve. The one or more valves may be electrically connected to the computer system 134. In certain embodiments, the computer system 145 is used to control the operation of the valves 1006, 1008 and 1010. In certain embodiments, the valves include any electrically activated valves without departing from the scope of the invention.

Figure 11B:
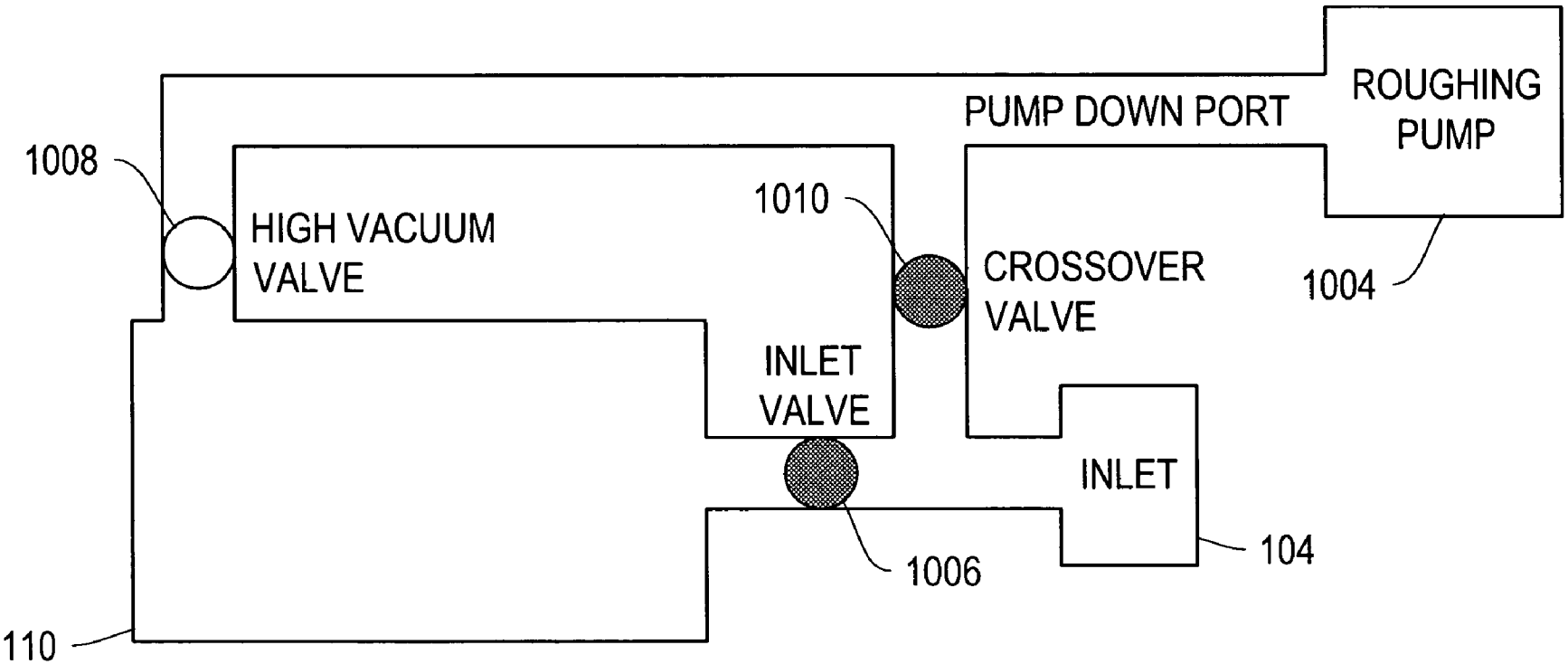

FIG. 11B depicts the operation of the valves 1006, 1008 and 1010 to establish low pressure conditions in the vacuum chamber 110. A roughing pump 1004 is connected to the vacuum chamber 110 and the high vacuum valve 1008 is opened. The valves 1006 and 1010 are kept closed. In certain embodiments, the roughing pump 1004 draws out air from the vacuum chamber 110 thereby helping establish low pressure conditions therein.

Figure 11C:
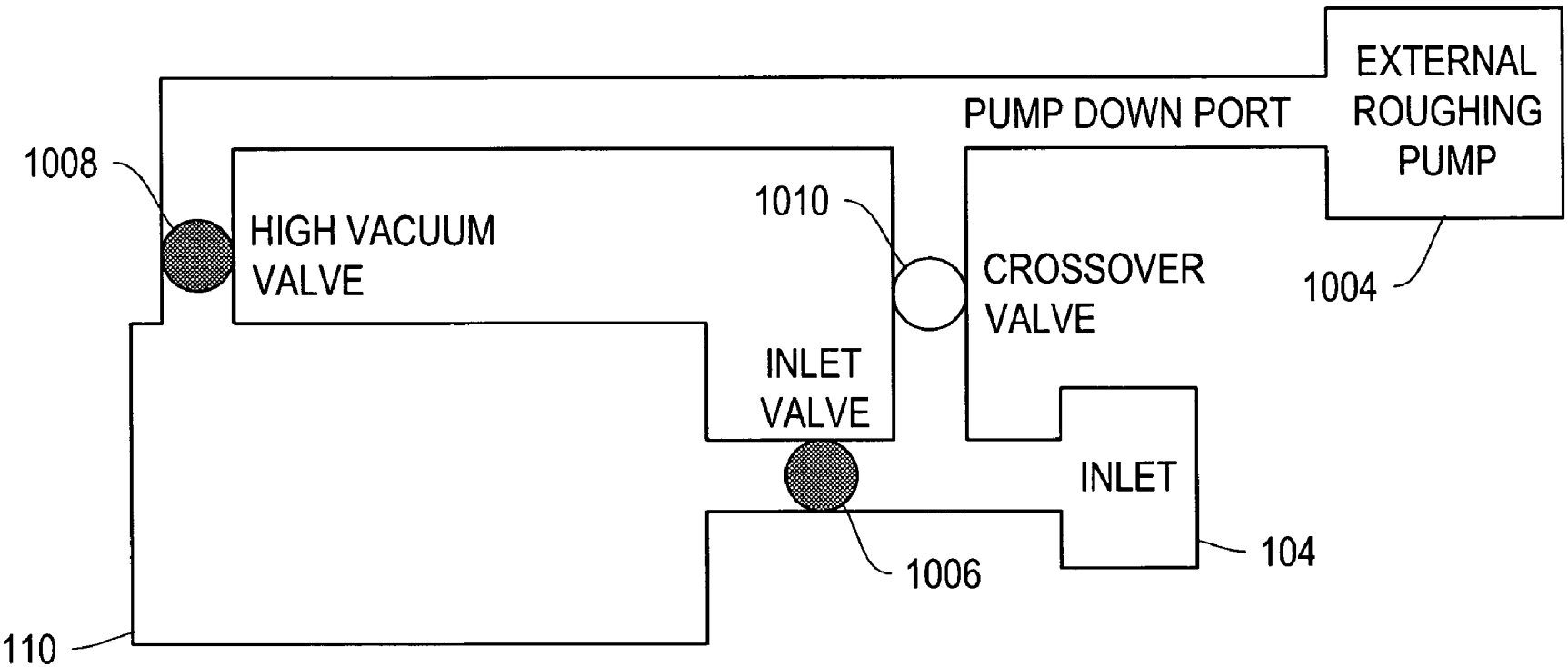

FIG. 11C depicts the operation of the valves 1006, 1008 and 1010 to establish low-pressure conditions in the inlet system 104. The crossover valve 1010 is opened and the inlet system 104 is connected to the roughing pump 1004. In certain embodiments, the roughing pump 1004 draws out air from the inlet system 104 thereby helping establish low-pressure conditions in the inlet system 104 and the inlet tube 108.

Figure 11D:
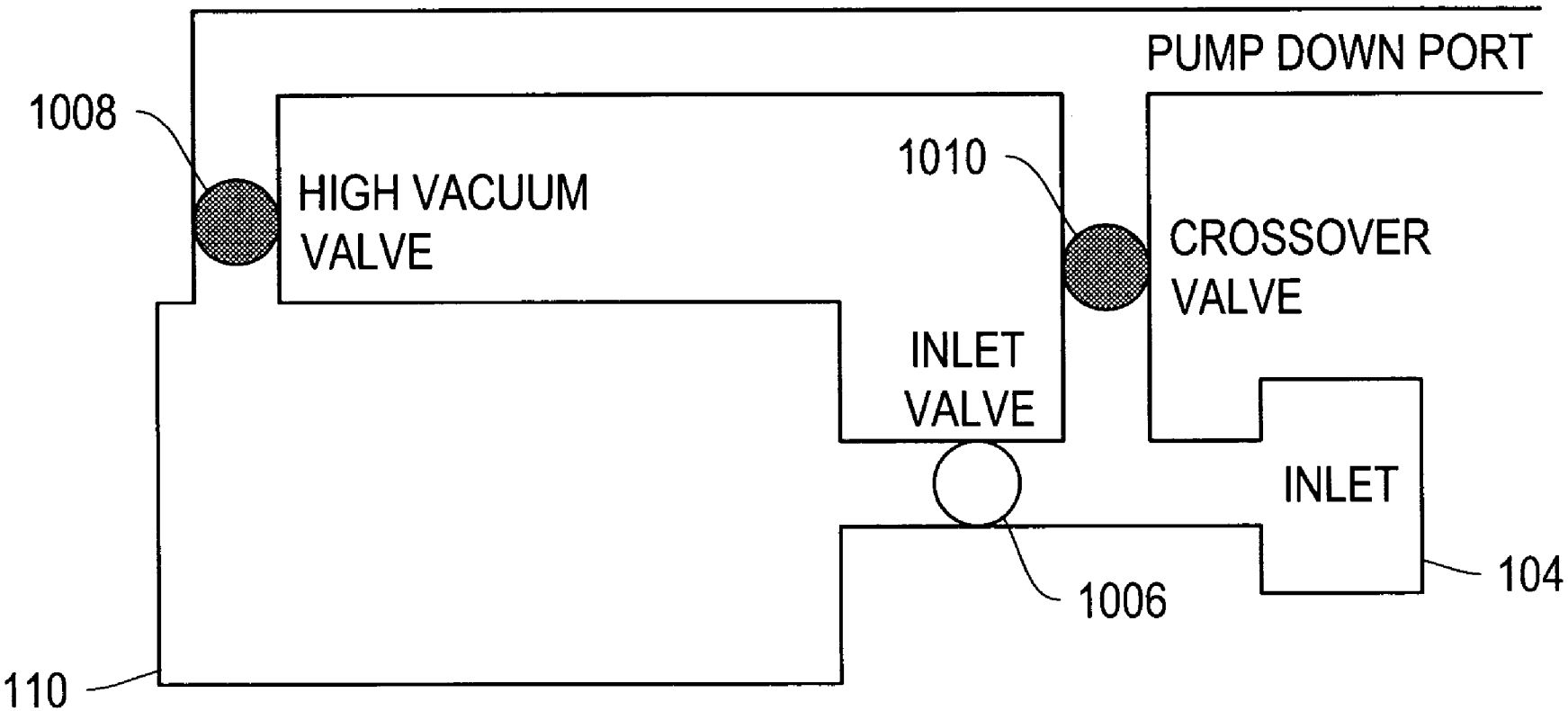

Turning to FIG. 11D, during operation the inlet valve 1006 is opened and the high vacuum valve 1008 and the crossover valve 1010 are closed. As described earlier, dissolved gases and or volatile chemical substances diffuse through the inlet system 104 via the inlet valve 1006 into the analyzer 118 in the vacuum chamber 110. In certain embodiments, in the event of a fault or malfunction in system 1000, the inlet valve 1006 is closed and the system 1000 enters the sleep/storage mode described earlier with reference to FIG. 11A.

Figure 12:
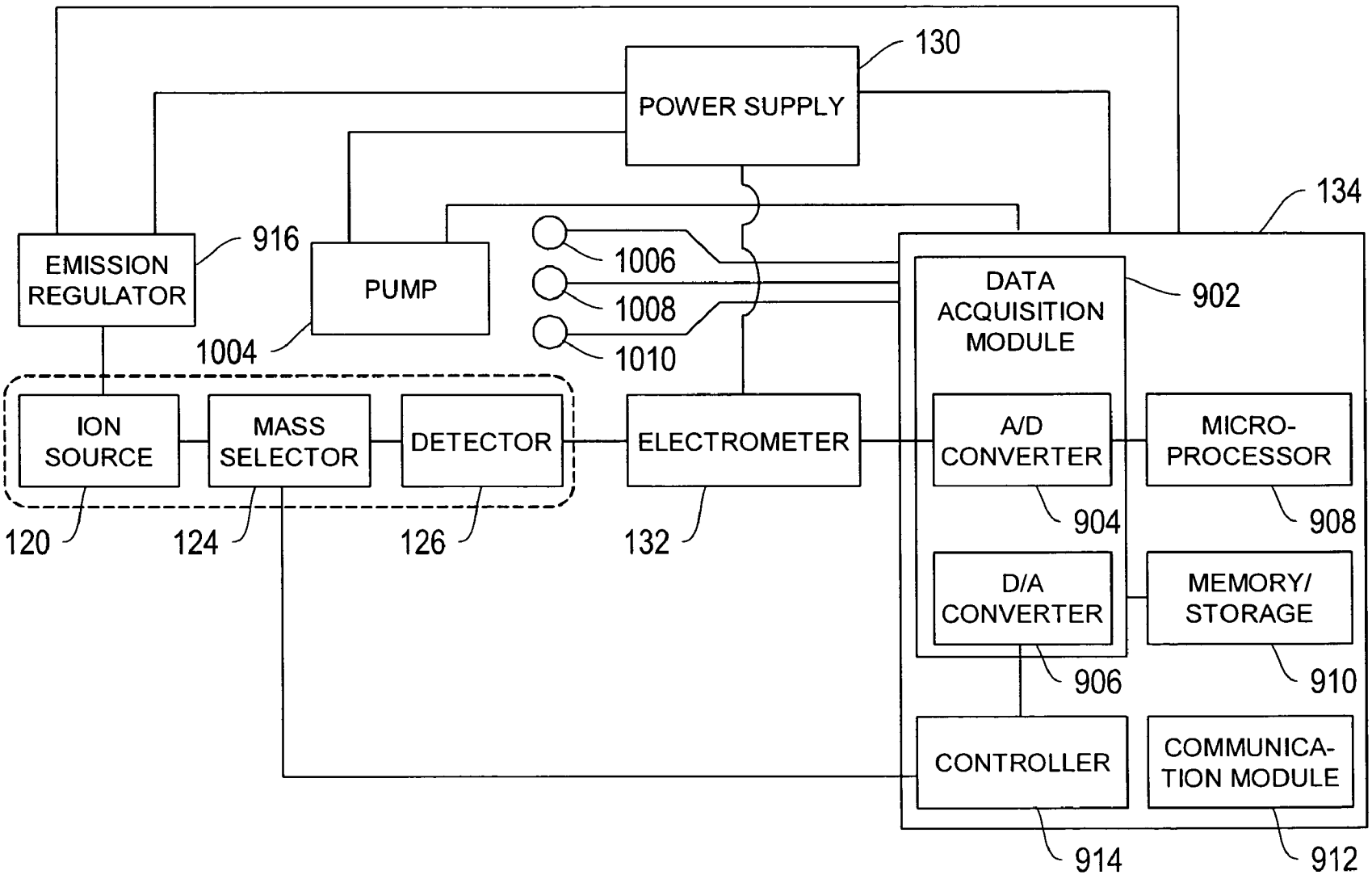
FIG. 12 depicts a computer system to be used with the system of FIGS. 1 and 3, according to an illustrative embodiment of the invention.

FIG. 12 depicts a computer system 134 to be used with the system 100 of FIG. 3, according to an illustrative embodiment of the invention. In particular, FIG. 12 depicts data acquisition, electronic control and communication systems of the system 100 of FIG. 3 and system 1000 of FIG. 10. The detector 126 in the analyzer 118 is connected to an electrometer 132. The electrometer 132 is connected to the computer system 134. The computer system 134 includes a data acquisition module 902 having an analog-to-digital converter 904 and a digital-to-analog converter 906, a microprocessor 908, a memory or storage 910 a communication module 912 and a controller 914. The electrometer 132 is connected to the A/D/converter 904. The D/A converter 906 is connected to the controller 914, which is connected to the mass selector 124. The power supply 130 supplies power to the ion source 120 through an emission regulator circuit 916, computer system 134, and the electrometer 132.

During operation, the electrometer 132 converts electrical currents generated by the detector 126 in response to the detection of ionized molecules to an electrical voltage signal. The electrical voltage signal is converted to digital signal in the A/D converter 904 located in the data acquisition module 902. The digital signal may then be processed and/or stored in the computer system 134 in at least one of the microprocessor 908 and the memory/storage 910. In certain embodiments, the digital data is sent via a communication module 912 wirelessly or through wire to a remote location. The D/A converter 906 located in the data acquisition module 902 converts instructions from the microprocessor 908 in digital form to an analog signal and sends these analog instructions to a controller 914. The controller 914 is connected to the mass selector 124 and operates at least one of the repeller, injector and accelerator plates located in the mass selector 124, thereby controlling the trajectory of the ions being detected. The emission regulator 916 regulates the power supplied to the ion source 120 and thereby reduces the overall power requirements of the system.

In certain embodiments, the electrometer 132 includes electrical and electronic circuits for detecting current generated by the detector 126. The electrometer 132 may be configured to detect ion currents of about $10^{-14}$ A. In certain embodiments, the electrometer 132 may be configured to generated voltages in the range of about −5 volts to +5 volts in response to detected currents. In other embodiments, the electrometer 132 may be configured to generated voltages in the range of about −10 volts to +10 volts with a minimum voltage of about 150 μvolts in response to detected currents. In such embodiments, the electrometer 132 is configured with one or feedback resistors having resistance values greater than $10^9$ Ohms. In certain embodiments, the electrometer 132 includes a glass type Victoreen feedback resistor having resistance of about $10^{10}$ Ohms. The electrometer 132 also includes an operational amplifier similar to the LMC 6001 field effect operational amplifier made by National Semiconductor, Santa Clara, Calif. and/or the LTC1151 operational amplifier made by Linear Technology Corporation, Milpitas, Calif. In certain embodiments, the electrometer 132 includes one or more components such as a Faraday cage to reduce the effect of stray voltages and electrical noise.

The computer system 134 includes a data acquisition module 902 having an analog-to-digital converter 904 and a digital-to-analog converter 906, a microprocessor 908, a memory or storage 910 a communication module 912 and a controller 914. The microprocessor 908 may include a single microprocessor or a plurality of microprocessors for configuring computer system 134 as a multi-processor system. In certain embodiments, the microprocessor 908 is capable of powering and calibrating the analyzer 118 at predetermined intervals, control at least one of the repeller, injector and accelerator plates, control the emission regulator and manage data collection and general system diagnostics. In certain embodiments, the computer system 134 consumes less than about 5 watts of power.

In certain embodiments, the analog-to-digital converter 904 includes a 7884 ADC and the digital-to-analog converter 906 includes a 569 DAC, both made by Analog Devices, Inc., Norwood, Mass. In certain embodiments, the controller 914 includes a isolated high-gain circuit for delivering electric potential to the mass selector 124 and particularly to the repeller, injector and the accelerator plates therein. The controller 914 may include other circuit components configured to receive control signals from the microprocessor 908 and the D/A converter 906.

The memory/storage 910 may include a main memory, a read only memory, various disk drives, tape drives, etc. The main memory 204 also includes dynamic random access memory (DRAM) and high-speed cache memory. In operation, the main memory stores at least portions of instructions and data for execution by the microprocessor 908. The storage 910 may include one or more magnetic disk or tape drives or optical disk drives, for storing data and instructions for use by the microprocessor 908. At least one component of the memory/storage 910, preferably in the form of a disk drive or tape drive, stores the database used for processing the detected signals from the analyzer 118 of system 100 of the invention. The memory/storage 910 may also include one or more drives for various portable media, such as a floppy disk, a compact disc read only memory (CD-ROM), or an integrated circuit non-volatile memory adapter (i.e. PC-MCIA adapter) to input and output data and code to and from the computer system 134.

The computer system 134 may also include one or more input/output interfaces for communications, shown by way of example, as communication module 912 for data communications. The communication module 912 may include a modem, an Ethernet card or any other suitable data communications device. In certain embodiments, the communication module 912 provides a relatively high-speed link to a network, such as an intranet, internet, or the Internet, either directly or through an another external interface. The communication link to the network may be, for example, optical, wired, or wireless (e.g., via satellite or cellular network). Alternatively, the computer system 134 may include a mainframe or other type of host computer system capable of Web-based communications via the network. In certain embodiments, the communication module 912 including a radio transceiver consumes less than about 150 mW of electric power. In other embodiments, the communication module 912 includes a standard wired serial interface for connecting a waterproof marine cable and capable of transmission at about 9,600 bits per second.

The computer system 134 may run a variety of application programs and stores associated data in a database of memory/storage 910. One or more such applications may enable the receipt and delivery of messages to enable operation as a server, for implementing server functions relating to processing data and controlling the analyzer 118.

The components contained in the computer system 134 are those typically found in general purpose computer systems used as servers, workstations, personal computers, network terminals, and the like. In fact, these components are intended to represent a broad category of such computer components that are well known in the art. Certain aspects of the invention may relate to the software elements, such as the executable code and database for the server functions of processing data and controlling the analyzer 118.

It will be apparent to those of ordinary skill in the art that methods involved in the present invention may be embodied in a computer program product that includes a computer usable and/or readable medium. For example, such a computer usable medium may consist of a read only memory device, such as a CD ROM disk or conventional ROM devices, or a random access memory, such as a hard drive device or a computer diskette, having a computer readable program code stored thereon.

In certain embodiments, at least one of the computer system 134, the electrometer 132, and the analyzer 118 are connected to the power supply 130. The power supply 130 may include one or more internal battery packs. In certain embodiments, power supply 130 includes one or more 12 volt DC power supply. The power supply 130 may include one or more internal 12 volt 7 ampere-hour sealed lead acid batteries. The power supply 130 may connect directly to one or more of the analyzer 118, the electrometer 132 and the computer system 134. In certain embodiments, the power supply 130 is connected to one or more DC-DC converters, which in turn provides the necessary electrical power to the analyzer 118, the electrometer 132 or the computer system 134. In certain embodiments, the power supply 130 includes a single central power supply capable of powering substantially all the components in system 100 of FIG. 3. In other embodiments, the power supply 130 includes a plurality of distributed power supply units for supplying power to each of the components in system 100 of FIG. 3. In such embodiments, one or more components have individual power supply units. In one implementation, the electrometer 132 is powered by an internal battery pack including a plurality of 1.5 volt AA and 9 volt alkaline batteries. In certain embodiments, the power supply 130 includes on or more high energy density batteries.

In certain embodiments, an emission regulator 916 is connected to the power supply 130 and to the ion source 120 of the analyzer 118. In certain embodiments, the emission regulator 916 manages the power supplied to the ion source 120. The emission regulator 916 may include circuits for generating square waves, power transistors and/or DC-DC converters. During operation, the emission regulator generates a periodic voltage wave, such as a square wave, having a desired duty cycle. The periodic wave may be rectified and sent to a DC-DC converter where the voltage is decreased and current is increased. The power generated at the DC-DC converter is supplied to the tungsten filament in the ion source 120. In certain embodiments, the energy losses are minimized by regulating the duty cycle of the periodic wave. The duty cycle of the periodic wave may be regulated, based at least on the number of electrons in the electron trap of the ion source 120. In certain embodiments, the emission regulator 916 draws about 9 watts of electrical power.

In certain embodiments, the inlet valve 1006, the high vacuum valve 1008 and the crossover valve 1010 previously depicted in FIGS. 10-11D are connected to the computer system 134. In certain embodiments, the operation of the valves 1006, 1008 and 1010 are controlled by the computer system 134. In certain embodiments, the computer system 134 is configured with software and/or hardware to automatically control the operation of the valves 1006, 1008 and 1010 depending on, among other things, a desired mode of operation. In certain embodiments, the mode of operation includes at least one of sleep/storage mode, standby/failsafe mode, normal operation, establishment of initial vacuums in the vacuum chamber 110 and the inlet system 104. In certain embodiments, the computer system 134 is configured to change the mode of the operation of the system 1000 by controlling the opening and the closing of each of the valves 1006, 1008 and 1010. The computer system 134 may be programmed to cycle through sleep, startup and normal operation modes that were described earlier with reference with FIGS. 11A-11D. In certain embodiments, the system 1000 is configured to duty cycle between operational and sleep states to conserve power and thereby allow operation for extended periods of time.

In certain embodiments, the microprocessor 908 and/or the memory/storage 910 includes one or more programs for calibrating the analyzer 118. In particular, the programs may include computer software for calibrating the mass-to-charge ratios relative to the controller 914 input voltage generated by the D/A converter 906. In certain embodiments, one or more calibration program are substantially autonomous and require limited or no external human or computer intervention.

In certain embodiments, the calibration methods include error checking procedures. In certain embodiments, the calibration program is repeated a pre-determined number of times. In certain embodiments, the calibration method begins when the computer system 134 boots up and then at hourly intervals thereafter. In one implementation, the calibration method includes scanning for one or more peaks at particular mass-to-charge ratios. The one or more peaks include 16 amu, 20 amu and 40 amu, and may be selected.

In certain embodiments, the analyzer 118 is calibrated based at least on theoretical principles and/or practical considerations. In such embodiments, the calibration methods include at least one of mass calibration techniques that are based on theoretical principles and peak intensity calibration techniques that may be based on practical considerations. Mass intensity calibration methods typically utilize principles of quantum physics to correct for apparent errors in data generated by the analyzer 118. In certain embodiments, the analyzer 118 includes a mass spectrometer and generates a data output including a mass spectrum representing the number of ions for each mass-to-charge ratios, In such embodiments, during mass calibration, mass quanta are used to reconcile apparent intensity values on a mass spectrum with actual intensity peaks predicted from quantum physics theory.

Peak intensity calibration techniques typically utilizes certain practical considerations in the environment or instrumentations to calibrate the analyzer 118. As an example, peak intensity calibration techniques may make use of the fact that certain gases such as Argon are at uniform concentrations throughout the ocean and change very little over long periods of time. Therefore, changes in the mass spectrum peaks of Argon may be attributed to effects of the system's operation (such as permeability, ionization strength and detector gain) rather than changes in the Argon concentration in the ocean. As another example, water vapor, being related to temperature, is used to calibrate instrumentation over a wide range of temperatures; based at least in part on the temperature, pressure and known permeability values, the systems 100 and 1000 may be calibrated despite changes in temperature and pressure of the surrounding environment.

In certain embodiments, one or more techniques for calibrating the analyzer include mass and peak calibration enable the system 100 to operate in an autonomous mode whereby data is collected, processed in real-time and this information is used to navigate the system 100 as desired.

The process described herein may be executed on a conventional data processing platform such as an IBM PC-compatible computer running the Windows operating systems, a SUN workstation running a UNIX operating system or another equivalent personal computer or workstation. Alternatively, the data processing system may comprise a dedicated processing system that includes an embedded programmable data processing unit. For example, the data processing system may comprise a single board computer system that has been integrated into a system for performing micro-array analysis.

The process described herein may also be realized as a software component operating on a conventional data processing system such as a UNIX workstation. In such an embodiment, the process may be implemented as a computer program written in any of several languages well-known to those of ordinary skill in the art, such as (but not limited to) C, C++, FORTRAN, Java or BASIC. The process may also be executed on commonly available clusters of processors, such as Western Scientific Linux clusters, which are able to allow parallel execution of all or some of the steps in the present process.

As noted above, the order in which the steps of the present method are performed is purely illustrative in nature. In fact, the steps can be performed in any order or in parallel, unless otherwise indicated by the present disclosure.

The method of the present invention may be performed in either hardware, software, or any combination thereof, as those terms are currently known in the art. In particular, the present method may be carried out by software, firmware, or microcode operating on a computer or computers of any type. Additionally, software embodying the present invention may comprise computer instructions in any form (e.g., source code, object code, interpreted code, etc.) stored in any computer-readable medium (e.g., ROM, RAM, magnetic media, punched tape or card, compact disc (CD) in any form, DVD, etc.). Furthermore, such software may also be in the form of a computer data signal embodied in a carrier wave, such as that found within the well-known Web pages transferred among devices connected to the Internet. Accordingly, the present invention is not limited to any particular platform, unless specifically stated otherwise in the present disclosure.

Figure 13:
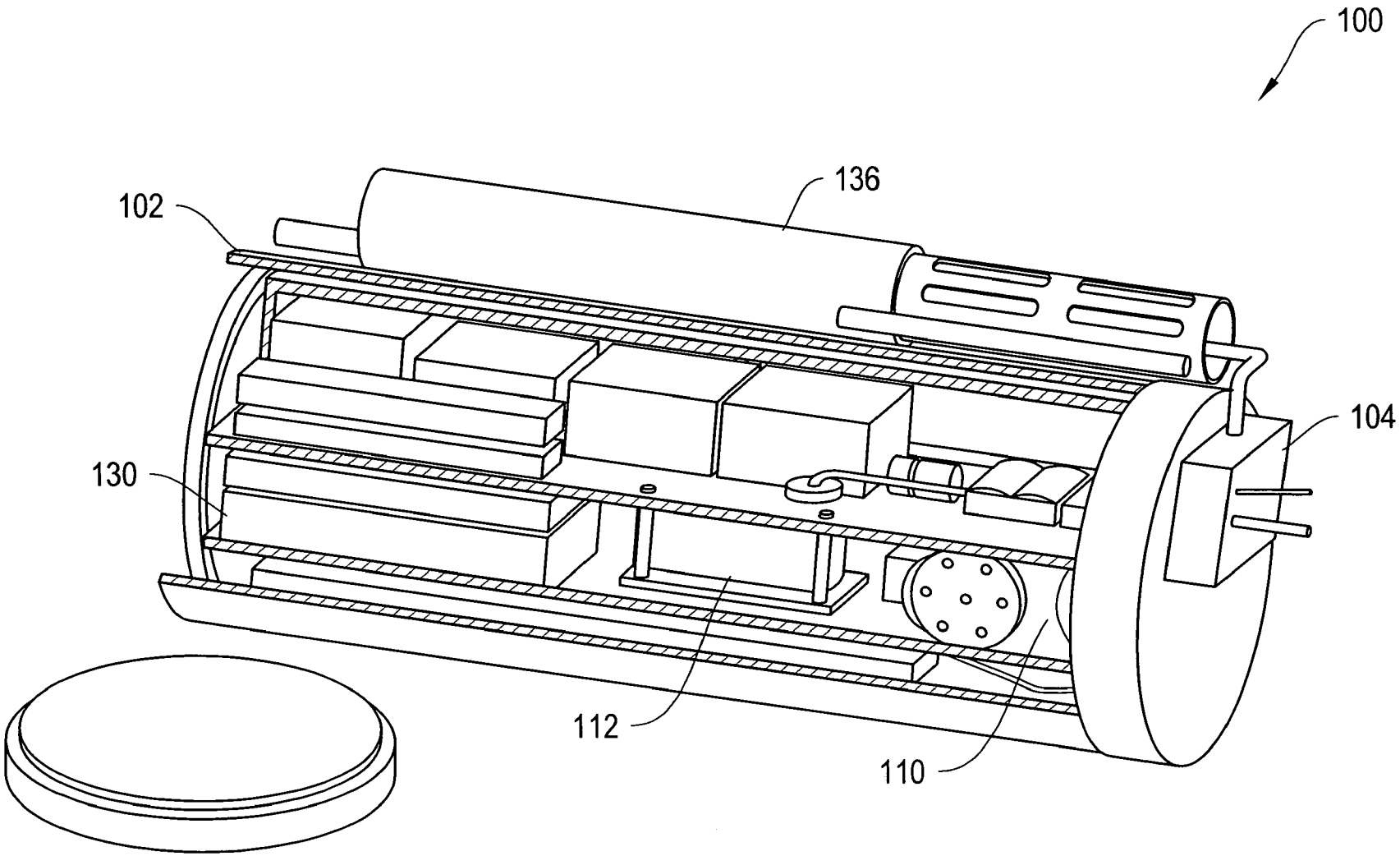
FIG. 13 depicts a system for performing a chemical analysis of an underwater system, according to an illustrative embodiment of the invention.

FIG. 13 depicts an exemplary systems 100 and 1000 for performing a chemical analysis of an underwater system. More particularly, FIG. 13 depicts an exemplary arrangement of various components of system 100 of FIG. 3. As illustrated, the housing 102 is cylindrically shaped and includes compartments for accommodating various components, The inlet assembly 104 is positioned on a flat surface of the housing 102. The analyzer 118 housed in the vacuum chamber 110 is positioned near the inlet assembly 104 inside the housing 102. The other components including the on-board computer system 134, power supply 130, vacuum pump 112 and measurement electronics 132 may be stacked within the housing 102. Sensor 136 extends along the length of the housing and terminates at the pump 138. The system 100 and its various components may be sized, shaped and arranged to fit within the housing 102. Each of the components of system 100 may be placed at any position within the housing 102 without departing from the scope of the invention.

In certain embodiments, the systems 100 and 1000 are shaped as a cylinder having a diameter of about 2 inches, a length from about 6 inches to about 8 inches and a weight of about 6 lbs. In certain embodiments, the system has a length less than about 6 inches or greater than about 8 inches. In certain embodiments, the system has a weight less than about 6 lbs or greater than about 6 lbs. In certain embodiments, the systems 100 and 1000 are sized and shaped to be used in combination with manned or un-manned vehicles. In certain embodiments, the systems 100 and 1000 are sized and shaped to be used as a wearable device.

In certain embodiments, the systems 100 and 1000 are operated in continuous operation mode such that they consume less than about 5 watts of electrical power. In certain embodiments, the systems 100 and 1000 are operated in duty-cycled mode such that they consume less than about 1 watt of electrical power.

In certain embodiments, the system 100 is configured to operate in air and/or water. and is capable of monitoring groundwater wells, monitoring air quality in subway tunnels and monitoring oil and natural gas pipelines. The system 100 may be configured to detect and monitor dissolved gases and volatile chemicals such as hydrocarbons, solvents, explosives, chemical weapons and pesticides. In certain embodiments, the system 100 is configured in a smaller housing 102 such that it can be used in logging while drilling operations. As an example, the system 100 can be used to determine hydrocarbon compositions and concentrations in oil and gas wells.

In certain embodiments, the systems 100 and 1000 include navigational components that assist in navigating through an environment based at least in part on the nature of the substances being analyzed. As an example, systems 100 and 1000 in search of methane gases in water may navigate through an underwater environment by measuring the concentration of methane in the surrounding environment and moving along a direction of increasing concentration of methane. In such an example, the computer system 134 may be configured to process the measurements in real-time and provide directional commands to the system 100 and 1000 based on these measurements.

In certain embodiments, the system 1000 and/or system 100 are configured with navigational devices such as compasses and satellite based global positioning systems (GPS). In such embodiments, the systems 100 and 1000 may transmit data along with a location such as a GPS coordinate to a remote computer. Such embodiments, may allow for correlating the nature of an environment with a geographical location. The navigational devices such as the GPS may also allow the system 100 and 1000 to navigate through an environment based on a pre-determined path defined by a set of GPS coordinates.

Variations, modifications, and other implementations of what is described may be employed without departing from the spirit and scope of the invention. More specifically, any of the method, system and device features described above or incorporated by reference may be combined with any other suitable method, system or device features disclosed herein or incorporated by reference, and is within the scope of the contemplated inventions. The invention may be embodied in other specific forms without departing from the spirit or essential characteristics thereof. The forgoing embodiments are therefore to be considered in all respects illustrative, rather than limiting of the invention. The teachings of all references cited herein are hereby incorporated by reference in their entirety.

Those skilled in the art will know or be able to ascertain using no more than routine experimentation, many equivalents to the embodiments and practices described herein. Accordingly, it will be understood that the invention is not to be limited to the embodiments disclosed herein, but is to be understood from the following claims, which are to be interpreted as broadly as allowed under the law.

The invention claimed is:

1. A system for performing a chemical analysis of substances in an underwater environment at a particular depth, comprising a housing, an inlet assembly, connected to the housing and capable of allowing one or more substances from the underwater environment to diffuse into the housing, wherein the inlet assembly includes an inlet body, a recess, an inlet membrane disposed proximate to the recess, and a backing plate positioned within the recess such that a gap is created between the inlet body and the backing plate for the substances to pass through the inlet membrane and the recess, a vacuum chamber disposed within the housing, capable of maintaining a vacuum and connected to the inlet assembly for receiving the one or more substances, an NEG-ion pump disposed within the housing and connected to the vacuum chamber for generating a vacuum therein, an analyzer disposed within the vacuum chamber for detecting one or more of the substances, and a magnet disposed near the vacuum chamber for generating a magnetic field within a portion of the analyzer.

2. The system of claim 1, wherein the housing is substantially formed from water impermeable materials.

3. The system of claim 1, wherein the housing is capable of withstanding a pressure greater than about 500 atmospheres.

4. The system of claim 1, wherein the particular depth is greater than about 2500 meters.

5. The system of claim 1, wherein the housing is formed from materials capable of being disposed in water for a length of time greater than about one month.

6. The system of claim 1, wherein the housing is substantially cylindrically shaped.

7. The system of claim 1, wherein the inlet membrane is formed from hydrophobic materials.

8. The system of claim 1, wherein the inlet membrane comprises a polymer.

9. The system of claim 8, wherein the polymer includes at least one of high-density polyethylene (HDPE), polymethylpentene (PMP), polypropylene, trespaphan GND, polytetrafluoroethylene, Hostaflon PFA, and polyimino-1-oxohexamethylene.

10. The system of claim 1, wherein the inlet assembly includes an inlet tube connecting the inlet membrane and the vacuum chamber.

11. The system of claim 1, wherein the backing plate is attached to the inlet membrane for providing additional structural support to the inlet membrane.

12. The system of claim 1, wherein a portion of the inlet assembly is disposed within the housing and a portion of the inlet assembly is disposed outside the housing.

13. The system of claim 1, wherein the inlet assembly extends outwardly from the housing.

14. The system of claim 1, wherein the vacuum chamber includes closable openings for connecting at least one of the inlet tube, the ion pump and control electronics.

15. The system of claim 1, wherein one or more of the magnetic members are disposed in between one or more pole pieces and the magnet carrier.

16. The system of claim 1, wherein the magnet includes a permanent magnet assembly having a magnet carrier, two magnetic members and two pole pieces tapered along one or more edges.

17. The system of claim 1, wherein the magnet includes a permanent magnet assembly having a magnet carrier, one or more magnetic members and one or more pole pieces tapered along one or more edges, the permanent magnet assembly has an asymmetric shape.

18. The system of claim 1, wherein the magnet includes one or more magnetic members formed from NdFeB.

19. The system of claim 1, wherein the magnet includes one or more pole pieces and magnet carrier formed from low carbon steel.

20. The system of claim 1, wherein the magnet is configured to generate a substantially homogenous magnetic field and includes a magnet carrier shaped to minimize fringing effects in the substantially homogeneous magnetic field.

21. The system of claim 1, wherein the magnet is sized and shaped to fit around a portion of the vacuum chamber.

22. The system of claim 1, wherein the analyzer includes an ion source for ionizing the one or more substances, a mass selector for separating the ionized substances, and a detector for detecting the ionized substances.

23. The system of claim 22, wherein the mass selector includes a cycloidal mass selector.

24. The system of claim 22, wherein the detector includes a Faraday cup detector.

25. The system of claim 22, wherein the ion source includes a heated tungsten filament.

26. The system of claim 1, comprising a flow pump connected to the inlet assembly for providing a continuous flow of at least one of water and one or more substances to a region near the inlet assembly.

27. The system of claim 1, comprising a flow pump connected to the inlet assembly for providing a continuous flow of at least one of water and one or more substances to a region near the inlet membrane.

28. The system of claim 26, wherein the flow pump includes an impeller pump.

29. The system of claim 1, comprising at least one of a conductivity sensor, a temperature sensor and a depth sensor.

30. The system of claim 1, comprising a computer connected to the analyzer for at least one of analyzing and storing the one or more detected substances.

31. The system of claim 30, comprising a controller connected to the computer and the analyzer for modifying the operation of at least one of the computer and analyzer in response to one or more of detected substances.

32. The system of claim 1, comprising one or more valves connected to at least one of the inlet assembly and the vacuum chamber.

33. The system of claim 32, comprising a roughing pump connected to at least one of the inlet assembly and the vacuum chamber.

34. The system of claim 1, comprising a navigational controller, for controlling one or more navigational components that assist in navigating through the underwater environment, based at least in part on the one or more substances detected by the analyzer.

35. The system of claim 34, wherein the navigational controller, based on the concentration of the one or more detected substances, provides one or more directional commands to the one or more navigational components to move towards a region, in the underwater environment, having a higher concentration of the one or more detected substances.

36. The system of claim 35, wherein the navigational controller is configured to control the operation of the analyzer within the region.

37. The system of claim 34, wherein the navigational controller includes a computer configured to analyze the one or more detected substances in real-time.

38. The system of claim 1, comprising a turbo-molecular pump disposed within the housing and connected with the NEG-ion pump for generating the vacuum in the vacuum chamber.

39. A system for performing a chemical analysis of substances in an underwater environment at a particular depth, comprising a water impermeable housing;

an inlet assembly, connected to the housing and capable of allowing one or more substances from the underwater environment to diffuse into the housing, comprising an inlet body having a recess, an inlet membrane disposed proximate to the recess, and a backing plate for supporting the inlet membrane and positioned within the recess such that a gap is created between the inlet body and the backing plate, wherein the gap provides a path for the substances to pass through inlet membrane and the recess;

a vacuum chamber disposed within the housing, capable of maintaining a vacuum and connected to the inlet assembly for receiving the one or more substances;

an analyzer disposed within the vacuum chamber for detecting one or more of the substances; and a magnet disposed near the vacuum chamber for generating a magnetic field within a portion of the analyzer.

40. The system of claim 39, wherein the gap between the inlet body and the backing plate reduces stress on the inlet membrane.

41. The system of claim 39, wherein the gap between the inlet body and the backing plate provides a short and continuous diffusion path, thereby allowing fast diffusion of the substances through the inlet membrane and the recess.

42. The system of claim 39, wherein the backing plate includes one or more surface slots that extend along a surface of the backing plate facing an opening of the inlet body.

43. The system of claim 42, wherein the one or more surface slots extend along the surface of the backing plate from one or more edges of the backing plate towards the center of the backing plate.

44. The system of claim 42, wherein the backing plate includes one or more side slots along a side surface of the backing plate.

45. The system of claim 44, wherein the one or more side slots are aligned with the one or more surface slots.

46. The system of claim 39, wherein the backing plate is cylindrically shaped.

47. A method for performing a chemical analysis of substances in an underwater environment at a particular depth, comprising providing a water impermeable housing connected to an inlet assembly and a vacuum chamber, wherein the inlet assembly includes an inlet body having a recess, an inlet membrane disposed proximate to the recess, and a backing plate for supporting the inlet membrane and positioned within the recess such that a gap is created between the inlet body and the backing plate;

allowing a substance from the underwater environment to diffuse into the water impermeable housing;

receiving the substance at the inlet assembly;

allowing the substance to pass through the inlet assembly via the gap between the inlet body and the backing plate;

generating and maintaining a vacuum at the vacuum chamber;

receiving the substance at the vacuum chamber from the inlet assembly; and detecting the substance via an analyzer disposed within the vacuum chamber.

* * * * *